US011029128B2

(12) United States Patent
Tedder et al.

(10) Patent No.: US 11,029,128 B2
(45) Date of Patent: Jun. 8, 2021

(54) ACTIVE COOLING FOR HOLSTER

(71) Applicant: Tedder Industries, LLC, Post Falls, ID (US)

(72) Inventors: Thomas Tedder, Post Falls, ID (US); Silas Van Natter, Post Falls, ID (US)

( * ) Notice: Subject to any disclaimer, the term of this patent is extended or adjusted under 35 U.S.C. 154(b) by 230 days.

(21) Appl. No.: 16/115,094

(22) Filed: Aug. 28, 2018

(65) Prior Publication Data

US 2019/0063870 A1 Feb. 28, 2019

Related U.S. Application Data

(60) Provisional application No. 62/551,413, filed on Aug. 29, 2017.

(51) Int. Cl.

| | |
|---|---|
| ***F41C 33/04*** | (2006.01) |
| ***F28F 13/00*** | (2006.01) |
| ***F41A 13/00*** | (2006.01) |
| ***F41C 33/02*** | (2006.01) |

(52) U.S. Cl.

CPC ..... *F41C 33/04* (2013.01); *F28F 13/003* (2013.01); *F41A 13/00* (2013.01); *F41C 33/02* (2013.01); *F28F 2250/08* (2013.01)

(58) Field of Classification Search

CPC ..... F41C 33/04; F41C 33/02; F28F 13/003; F28F 2250/08; F41A 13/00

See application file for complete search history.

(56) References Cited

U.S. PATENT DOCUMENTS

| | | | | |
|---|---|---|---|---|
| 2009/0031467 | A1* | 2/2009 | Swindells | A41D 13/0012 2/51 |
| 2015/0374045 | A1* | 12/2015 | Codner | A61F 7/02 2/455 |
| 2016/0216065 | A1* | 7/2016 | Tedder | F41C 33/041 |
| 2018/0092455 | A1* | 4/2018 | Kim | A45F 3/10 |

* cited by examiner

*Primary Examiner* — Jon T. Schermerhorn, Jr.

(57) ABSTRACT

Representative implementations of devices and techniques provide a cooling system for an implement holster (such as a handgun holster, for example). In various embodiments, the cooling system provides fluid flow through at least a portion of the holster to cool the holster and the user. For example, the cooling system includes a cooling assembly adapted to move a fluid through a ducting layer of a multi-layer holster backer.

24 Claims, 18 Drawing Sheets

ACTIVE COOLING FOR HOLSTER

PRIORITY CLAIM AND CROSS-REFERENCE TO RELATED APPLICATION

This application claims the benefit under 35 U.S.C. § 119(e)(1) of U.S. Provisional Application No. 62/551,413, filed Aug. 29, 2017, which is hereby incorporated by reference in its entirety.

BACKGROUND

Implements, such as tools, weapons, and the like, may be temporarily encased in a carrier (such as a holster, for instance) for protection of the implement and/or the user, while providing access to the implement. For example, a carrier may allow a user to conveniently carry the implement, safely retaining the implement until needed. When the implement is to be used, the user may withdraw the implement from the carrier, and then return it to the carrier when finished. In some cases, such as with a handgun for example, the holster may allow the user to conceal the implement, or to conceal the fact that the user is carrying the implement.

In the case of a handgun, the holster should reasonably protect the handgun and the user, and should be convenient to the user for ready use. However, the holster should also be versatile enough to be comfortably carried by the user, such as when it is worn on the person of the user for an extended length of time. The holster should also be rigid and stable enough to allow the handgun to be repeatedly drawn and re-holstered, usually with the same hand.

Wearing a holster on the user's body, particularly for an extended length of time can become uncomfortable for the user if doing so generates or localizes heat felt by the user. In some cases, a holster next to the user's body traps the user's body heat at the location of the holster, causing increased perspiration and potentially causing discomfort to the user. It can be difficult for the perspiration to evaporate due to the proximity of the holster. Consequently, it can be difficult to cool the user without removing the holster.

Also, a handgun can generate a certain amount of heat with use, and can generate considerable heat when used repeatedly, such as during shooting competitions and the like. With many holsters, the heat generated by the handgun may be transferred to the user, making the holster and the handgun uncomfortable to wear against the user's body. This can be especially problematic with many conceal carry holsters, which generally rest closer to the user's body, if not resting directly in contact with the user's body. In many cases, the heat generated by the handgun is in addition to the user's body heat at the holster location.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Overview

Figure 1:
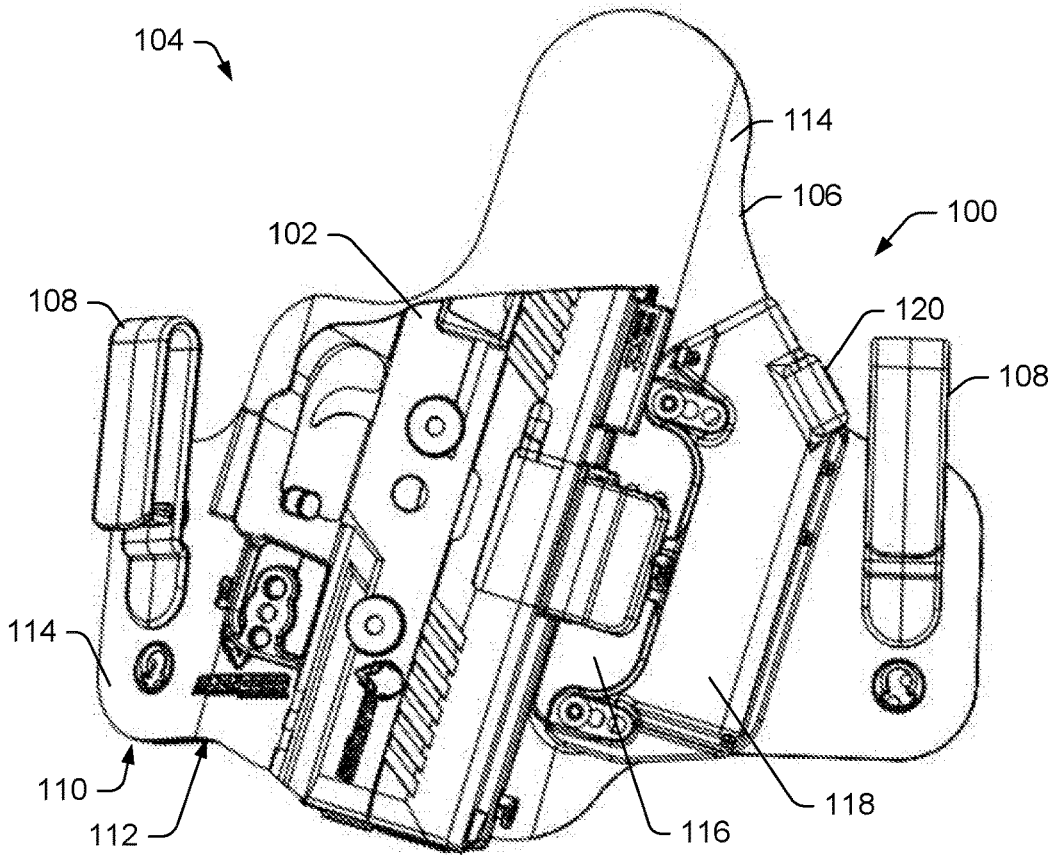
FIG. 1 shows a front perspective view of an example holster with a cooling system, according to an implementation.
Figure 2:
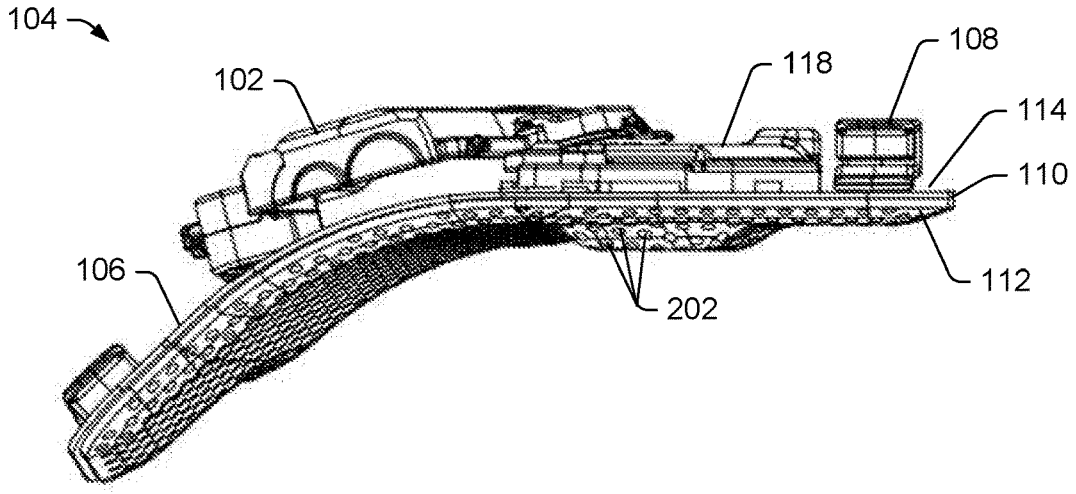
FIG. 2 shows a bottom perspective view of an example holster with a cooling system, according to an implementation.
Figure 3:
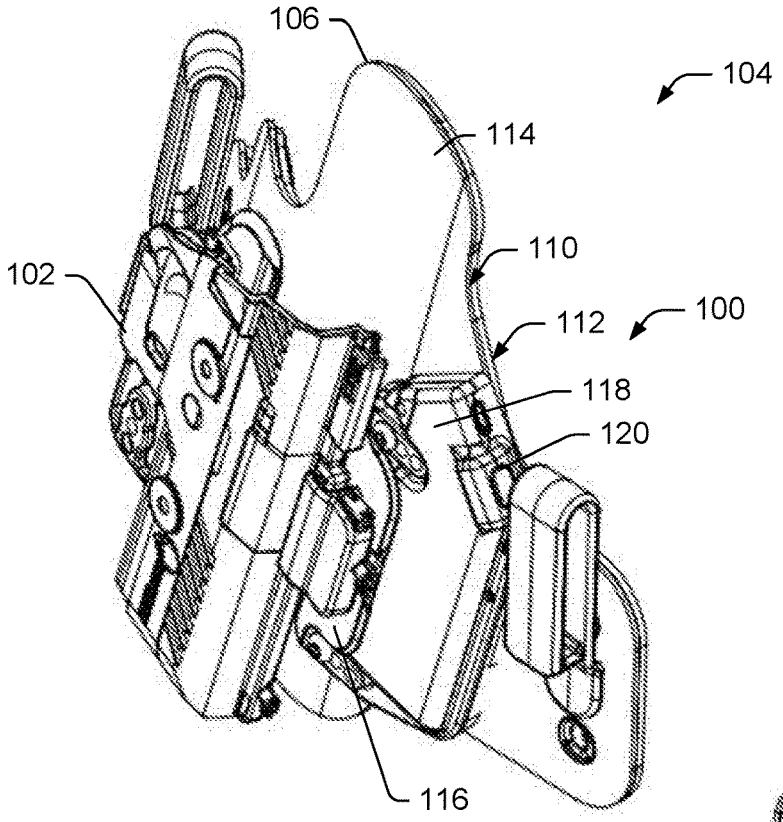
FIG. 3 shows a top perspective view of an example holster with a cooling system, according to an implementation.
Figure 4:
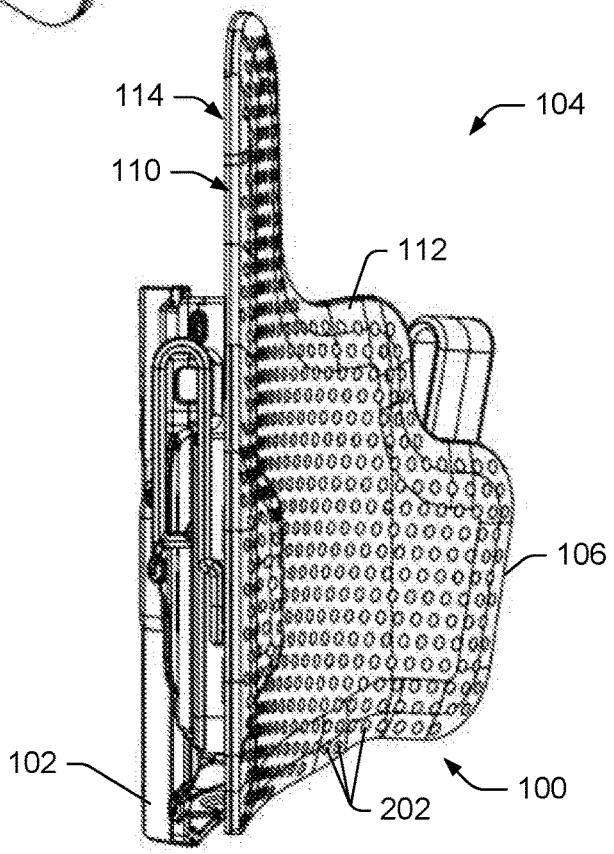
FIG. 4 shows a side perspective view of an example holster with a cooling system, according to an implementation.
Figure 5:
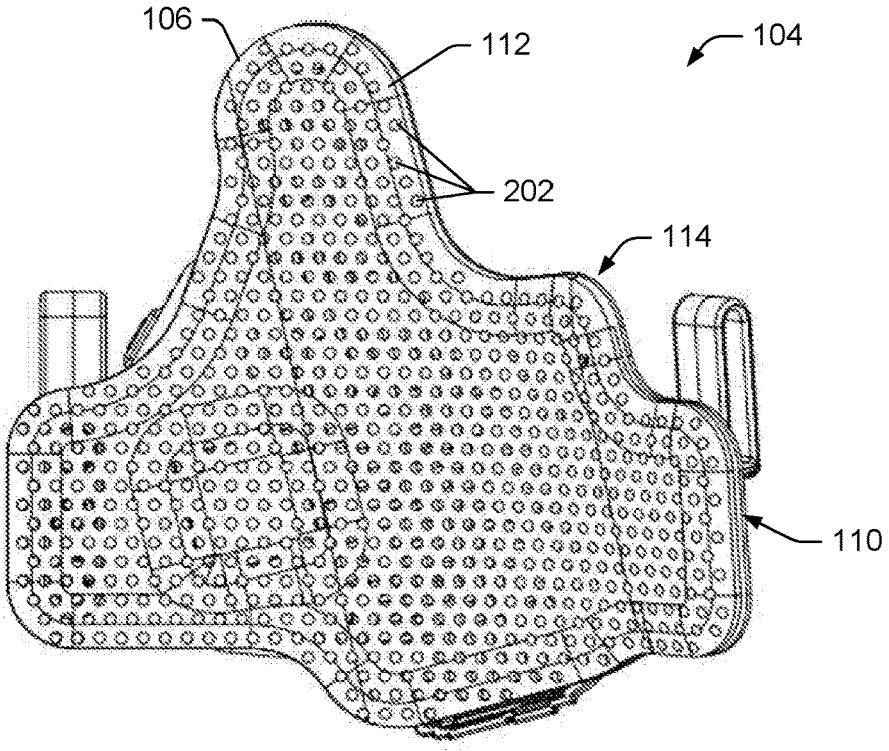
FIG. 5 shows a back perspective view of an example holster with a cooling system, according to an implementation.
Figure 6:
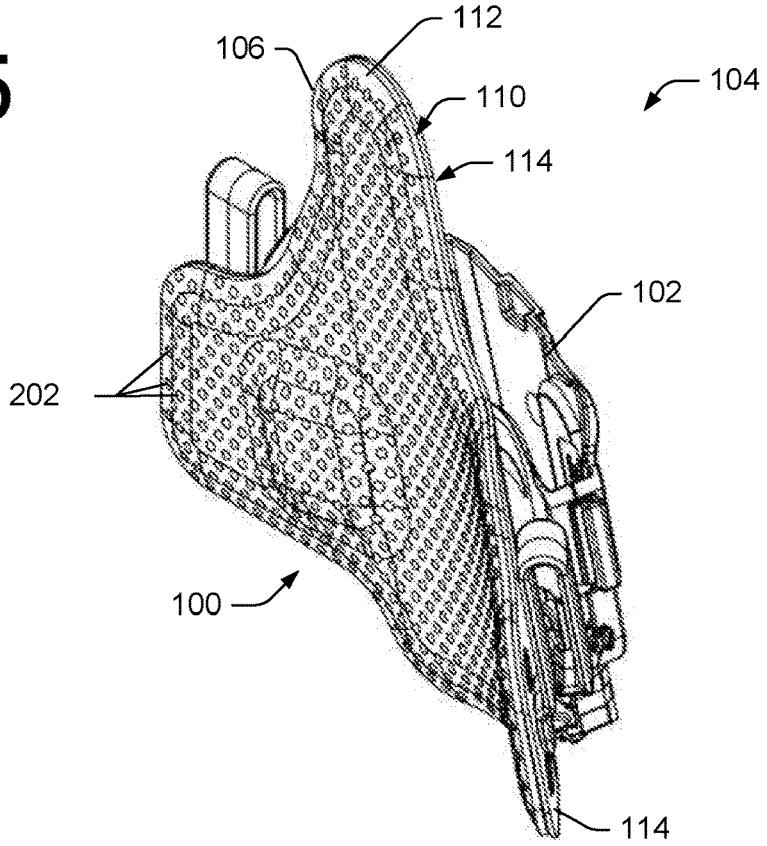
FIG. 6 shows another side perspective view of an example holster with a cooling system, according to an implementation.

Representative implementations of devices and techniques provide a cooling system for an implement holster (such as a handgun holster, for example). In various embodiments, the cooling system provides fluid flow through at least a portion of the holster to cool the holster and the user. For example, the fluid flow of the cooling system can help to evaporate perspiration from the user in the area of the holster, and to conduct heat away from the holster and the handgun.

In various embodiments, the cooling system includes a multi-layered backer having two or more uniquely arranged layers. In the embodiments, one or more of the layers of the backer are arranged to conduct the flow of a fluid (air, gas, liquid, etc.) through the backer and through one or more portions of the holster. For instance, one or more layers of the backer (i.e., a ducting layer) may include duct, conduit, tubing, directional features, fins, channels, or other features or components arranged and adapted to conduct the flow of fluid.

In some embodiments, the backer of the cooling system includes one or more layers arranged to be placed on or near the body of the user to conduct the cooling effects of the cooling system to the user. For instance, in one example, the backer includes a perforated or otherwise breathable layer that is arranged to be nearest to the user's body. In an embodiment, the breathable layer conducts air (or the like) onto the body of the user from the ducting layer. For instance, the breathable layer may be directly or indirectly coupled to the ducting layer. The movement of air on the user's body works to evaporate moisture on the user's body, cooling the user at the location of the holster.

In various embodiments, the cooling system includes a cooling assembly comprising one or more fans, pumps, blowers, or the like, adapted to move fluid through the ducting layer. In the embodiments, the cooling assembly pulls or pushes the fluid through the ducting layer, from one or more sources of the fluid (or inputs) to one or more outputs. In one example, the outputs comprise perforations, openings, spaces, or the like, in the breathable layer. In other examples, the outputs comprise other cooling dispersal components.

In some implementations, the cooling system may be powered by an internal and/or external direct current (DC) power supply. In other implementations, the cooling system may be partly or fully powered by other sources, including solar power, compressed gas, sublimation, or the like.

In various embodiments, the cooling system is integral to a holster or other carrier. For example, the multi-layer backer comprises the backer for a cooled holster system. In one example, the cooling system, including the multi-layer backer, may be adapted to be interchangeably coupled to various implement holsters or holster shells (or the like) for cooling a user in the area that the holster (or the backer) is pressing against the body of the user. For example, the cooling system may be a modular system adaptable to many and various carriers and carrier applications (such as various handgun holsters, and the like, for example).

In an example implementation, the cooling system can be installed and removed from a holster, or interchanged by a user as desired, to add cooling to a holster (such as a hybrid holster as shown in FIG. 1, or another style of holster). For example the backer of a holster may be exchanged for the multi-layer backer and integrated cooling system as described herein. In other implementations, the cooling system, including the backer, may be a permanent part of the holster (or other carrier).

Techniques and devices are discussed with reference to example handgun holsters illustrated in the figures. However, this is not intended to be limiting, and is for ease of discussion and illustrative convenience. The techniques and devices discussed may be applied to a holster or to any of various cases, carriers, sheaths, containers, implements, tools, tool belts, objects, and the like, and remain within the scope of the disclosure. For the purposes of this disclosure, the generic term "carrier" is used to indicate any or all of the above.

Additionally, the techniques and devices are discussed and illustrated generally with reference to an inside waistband (IWB) style holster. This is also not intended to be limiting. In various implementations, the techniques and devices may be employed with outside waistband (OWB) holsters, as well as holsters worn at the back, chest, side, thigh, or ankle of a user, holsters carried in a bag, purse, or pocket, or carried or worn on a belt, a strap, or in any other manner (e.g., attached to a vehicle, an object of furniture, another object, etc.). In alternate implementations, the techniques and devices may be employed in other ways or with other devices, systems, instruments, or the like.

Further, the shape and quantity of the cooling system components illustrated in the figures may vary to accommodate various applications. In alternate embodiments, fewer, additional, or alternate components may be used and/or combined to form a cooling system or a cooled holster system having an equivalent function and operation.

Implementations are explained in more detail below using a plurality of examples. Although various implementations and examples are discussed here and below, further implementations and examples may be possible by combining the features and elements of individual implementations and examples.

EXAMPLE EMBODIMENTS

FIGS. 1-29 illustrate example embodiments of a cooling system 100 for a carrier 102 (such as a handgun holster, for example), in various non-limiting configurations. The illustrations of the components of the cooling system 100 and the carrier 102 as shown in FIGS. 1-29 are not intended to be restrictive, and the components may have other shapes, dimensions, orientations, and so forth, while performing the functions (or equivalent functions) described herein, and without departing from the scope of the disclosure.

FIGS. 1-6 show various views of a carrier 102 with a cooling system 100, according to an implementation. When combined, the cooling system 100 and the carrier 102 comprise an actively cooled holster 104. In the illustrated example, the carrier 102 comprises a holster shell, or the like, adapted to carry an implement (such as a handgun, for example). In various other examples, the carrier 102 may comprise any of various cases, sheaths, containers, enclosures, tool belts, and the like. The carrier 102 may be removably or permanently coupled to a backer 106, for instance, adapted to support the carrier 102. In some examples, the backer 106 and the carrier 102 combine to encase the implement. For instance, the backer 106 and the carrier 102 may be removably or permanently coupled together, and form an enclosure for the implement when coupled. In other examples, the carrier 102 may form an enclosure, which is coupled to the backer 106. One or more clips 108 (or the like) may be coupled to the backer 106 or to the carrier 102 to suspend the carrier 102 from a belt, or other support object.

As shown in FIGS. 1-6, at least a portion of the cooling system 100 can be coupled to or integrated into the backer 106. For example, the backer 106 may be comprised of multiple layers, and one or more of the layers may be part of the cooling system 100. In an embodiment, the one or more layers comprising the cooling system 100 include a ducting layer 110 and a breathable layer 112. In another embodiment, the backer 106 also includes a load bearing surface layer 114. For instance, the multiple layers of the backer 106 may include one or more layers 110 and 112 arranged to provide cooling to the user, combined with one or more layers 114 arranged to provide a suitable backer surface for the carrier 102. In alternate embodiments, one of the layers 110 and 112 may also function as a layer 114, or in other words, a suitable load-bearing surface for the carrier 102. In other embodiments, other layers may also be part of the backer 106 and/or the cooling system 100.

Figure 7:
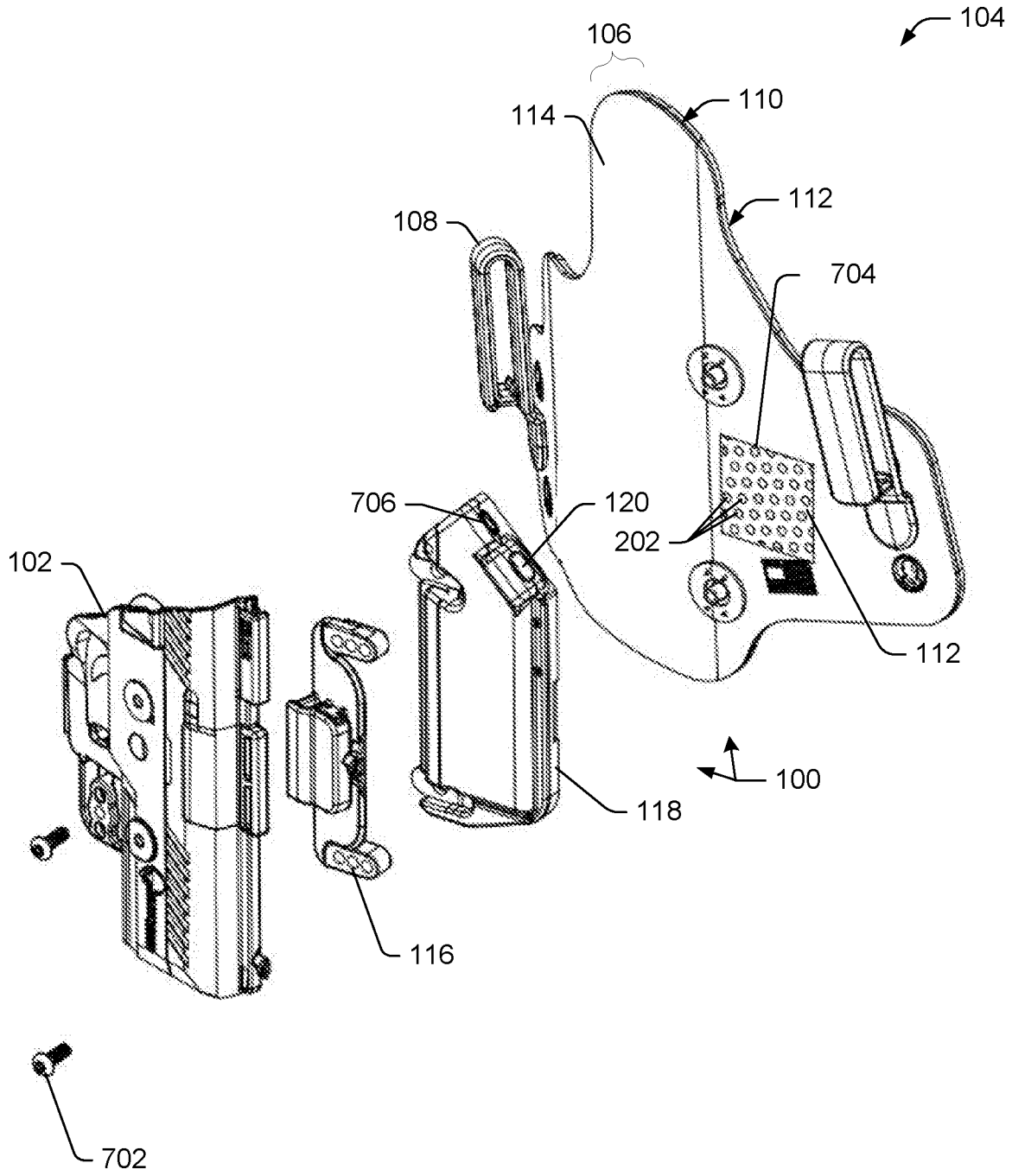
FIGS. 7-9 show exploded views of an example holster with a cooling system, according to an implementation.
Figure 8:
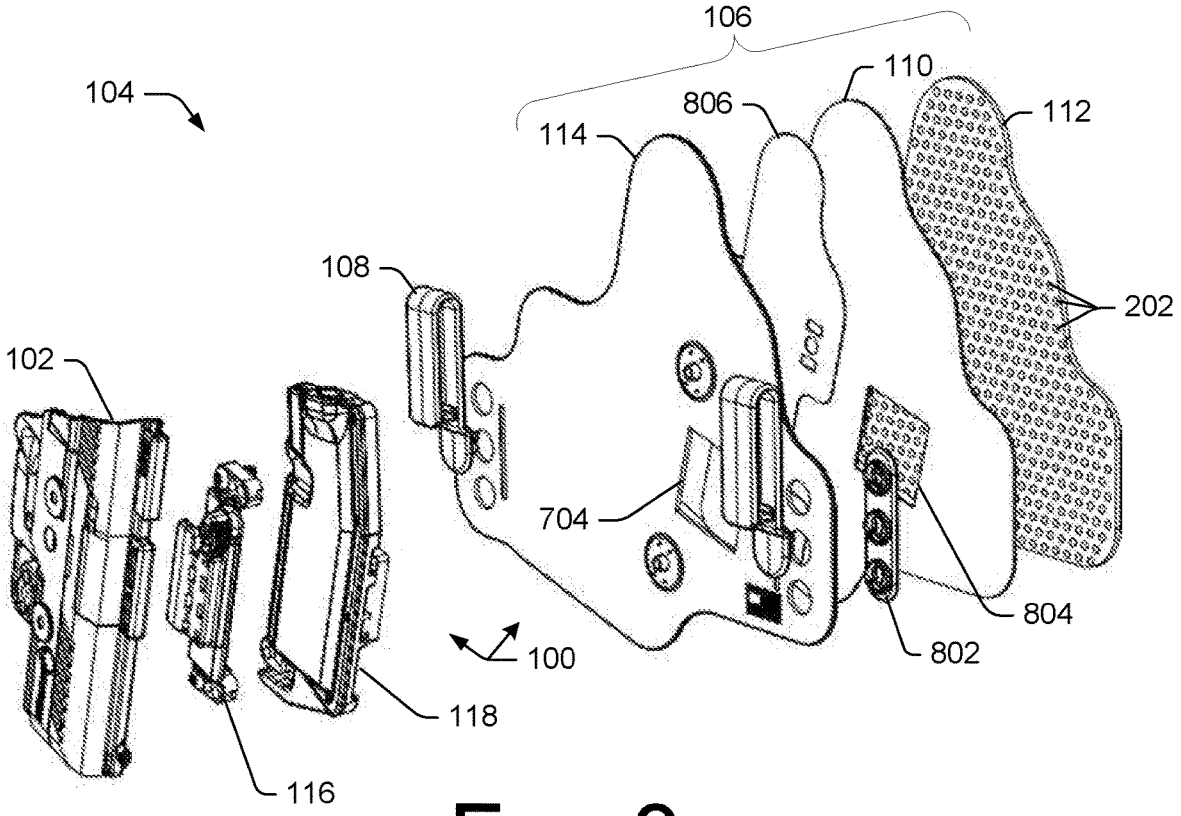
Figure 9:
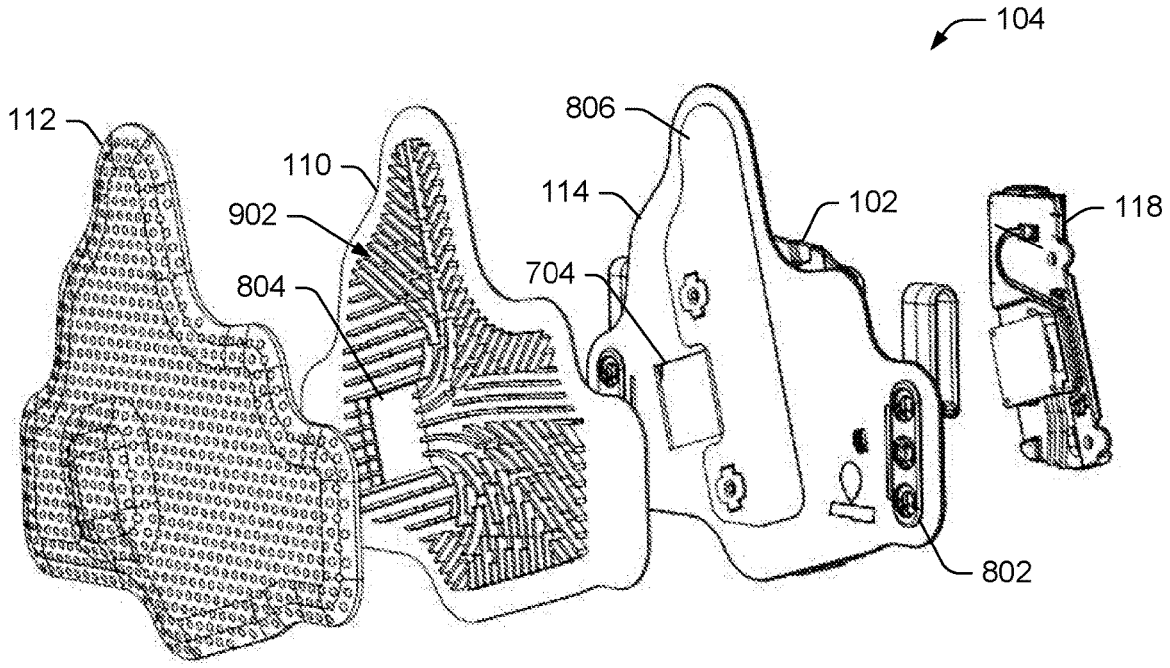

FIGS. 7-9 show exploded views of the example actively cooled holster 104, including the cooling system 100 and the carrier 102, according to an implementation. As shown in FIG. 7, the carrier 102 can be removably or permanently coupled to the multi-layer backer 106 via one or more backer latch attachments 116. One or more removable or permanent fasteners 702 may also be used to couple the carrier 102 to the backer 106 and/or to couple the backer latch attachment 116 to the backer 106. The backer latch attachment 116 may include one or more features, locks, clasps, or the like, adapted to couple the carrier 102 to the backer 106. As shown in FIG. 8, the backer latch attachment 116 may also be used to couple parts of the cooling system 100 to the backer 106, such as the cooling assembly 118, for example.

As also shown in FIG. 8, in some embodiments, an adjustable clip receiver 802 can be used with one or more layers of the backer 106 to adjustably couple the clips 108 to the backer. In some examples, the adjustable clip receiver 802 may protrude through all of the layers (114, 110, 112, etc.) of the backer 106 to attach to the clips 108. In other examples, the adjustable clip receiver 802 may be sandwiched between two layers, and protrude out the first layer 114 to attach to the clips 108. Each adjustable clip receiver 802 can have multiple attachment points for attaching each of the clips 108 at one of multiple positions onto the backer 106, for customizing a ride height and cant of the holster system 104. In some embodiments, the adjustable clip receiver 802 is a tool-less attachment component for ease of clip removal, installation, and adjustment.

Referring to FIGS. 1-9, in an embodiment, the backer 106 may include a first layer 114 (surface layer 114) comprising a tough supporting material arranged to be in contact with the implement (such as a firearm) or nearest to the implement. This first layer 114 may be comprised of a natural or synthetic leather material, a plastic material, or the like, with desired stiffness and durability. The first layer 114 may also include one or more openings 704 arranged to allow fluid to pass through the first layer 114 and through to the inner layers (e.g., 110, 112, etc.) of the backer 106, as described below. For example, the one or more openings 704 may align with a portion of a feature, channel, duct, etc. or with one or more inlet/outlets associated with the ducting layer 110 described below. In an embodiment, one or more openings 704 in the first layer 114 may comprise an inlet or an outlet, as described below.

In an embodiment of a cooling system 100, the backer 106 includes a ducting layer 110, having one or more features 902 such as channels, duct, conduit, tubing, directional features, fins, or other features or components arranged and adapted to conduct the flow of fluid (see FIG. 9, for example). For example, directional features may include tabs, slots, grooves, walls, ridges, and so forth that can affect the direction of fluid travel within the ducting layer 110. The features 902 may be formed on or within the ducting layer 110, or be coupled to the ducting layer 110, to provide one or more passages for the movement of fluid, as desired for cooling.

In various examples, the ducting layer 110 may be comprised of non-breathable neoprene, a high-density compression resistant flexible foam, one or more polymers, composites, or other suitable materials. Thus, the ducting layer 110 may be impermeable to fluids and be arranged to provide a leak resistant or leak proof conduit for fluid movement. Alternately, the ducting layer 110 may be comprised of a breathable neoprene, a lower density foam, or permeable polymer or other material, and may be adapted to leak fluid at a predetermined rate as the fluid moves through the features 902. For instance, the fluid leakage may be a part of fluid dispersion for cooling.

In an embodiment, as shown in FIGS. 8 and 9, the ducting layer 110 may include an opening 804 to allow fluid to pass from the opening 704 of the first layer 114 through the ducting layer 110 and to the features 902 (and/or the breathable layer 112) on the opposite side (the breathable layer 112 side) of the ducting layer 110. In various embodiments, the opening 804 may be aligned to the opening 704, or the openings 804 and 704 may be joined by features, channel, conduit, duct, or the like (which may be integrated into one or more of the layers 110 and 114 or may be separate components).

The features 902 in the ducting layer 110 can be arranged to cover much of the area of the backer 106, to provide the cooling desired over the area of the backer 106 desired (see FIG. 9, for example). The features 902 may be arranged in one or more patterns or groups, to direct the flow of fluid through the ducting layer 110. The ducting layer 110 may include at least one inlet and at least one outlet connected to the features 902 to allow fluid to circulate through the features 902. In some embodiments, the ducting layer 110 includes multiple inlets and multiple outlets connected to the features 902. In other embodiments, the inlets and/or outlets are included on one or more other layers (e.g., layers 112 and 114), which are coupled to the features 902 of the ducting layer 110.

In an example, fluid (such as air, for example) can flow into one or more of the inlets, through the features 902, and out of one or more of the outlets to provide cooling through fluid movement. The fluid movement can assist with evaporation of the user's perspiration, for example, providing cooling to the user. In some embodiments, the ducting layer 110 can include multiple features 902 and/or multiple inlet/outlets. In an alternate implementation, the inlets and outlets are interchangeable—that is, the fluid can move in either direction.

In an implementation, the ducting layer 110 may be arranged to be accessed by a user, using fasteners, such as hook and loop fasteners, snaps, zip-type seals, or the like. The user may disassemble the backer 106, by separating one or more of the layers 110, 112, 114 for cleaning, or the like.

Referring to FIGS. 1-9, in an embodiment of a cooling system 100, the breathable layer 112 of the backer 106 includes a breathable mesh or like fabric disposed over the ducting layer 110 and positioned next to the user's body. The breathable layer 112 allows the effects of the fluid flow through the ducting layer 110 to be felt by the user, cooling the user and assisting in evaporating perspiration on the user's body. In various examples, the breathable layer 112 comprises a 3D mesh, a 3D spacer fabric, or other breathable fabric or materials. The breathable layer 112 may be arranged to have a desired thickness to optimize comfort and cooling capability.

Referring to FIGS. 2-9, in an embodiment, multiple openings 202 are disposed throughout the breathable layer 112. The openings 202 may comprise formed or naturally occurring holes, apertures, or perforations in the breathable layer 112, spaces in the weave of the fabric of the breathable layer 112, slots or channels in the breathable layer 112, or any other formation that may be used to pass fluid for cooling.

The multiple openings 202 may comprise outlets for fluid flow from the ducting layer 110. For instance, in one example, the breathable layer 112 allows air from the ducting layer 110 to pass through the openings 202 of the breathable layer 112. The openings 202 may be coupled to individual features 902 or groups of features 902, to form an exit for fluid traveling within the ducting layer 110. Alternately, the openings 202 may not be coupled directly to any features 902. Rather, the breathable layer 112 can be coupled to the ducting layer 110, so that the fluid moving through the features 902 can escape through any of the openings 202. In such an embodiment, the ducting layer 110 may be sealed to the breathable layer 112 if desired, around a perimeter of the layers 110 and 112, on the features 902, or at some other convenient location on the layers 110 and 112 (e.g., at one or more boundaries, at designated features 902, or the like).

Referring to FIGS. 1, 3, and 7-10, in various implementations, the cooling system 100 includes a cooling assembly 118. To assist in the movement of fluid, the cooling assembly 118 can include one or more fans, pumps, blowers, (combinations of fans, pumps, and blowers) or other components adapted to move fluid through the ducting layer 110. In an embodiment, the cooling assembly 118 can be incorporated at some point along the features 902 of the ducting layer 110, or at one of the inlet/outlets. The cooling assembly 118 can pull or push fluid through the features 902 of the ducting layer 110 to create or increase the flow of fluid through the ducting layer 110 and the outlets (such as openings 202, for example). In various examples, the cooling assembly 118 can run forwards or backwards, at one or more speeds, as determined by the user, preset or automatic controls, or the like.

Figure 10:
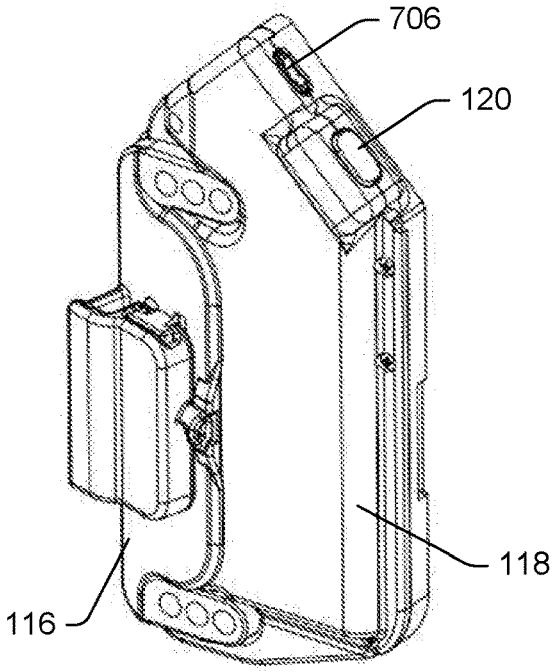
FIGS. 10-12 show front, back, and side perspective views, respectively, of an example cooling assembly for a holster, according to an implementation.
Figure 11:
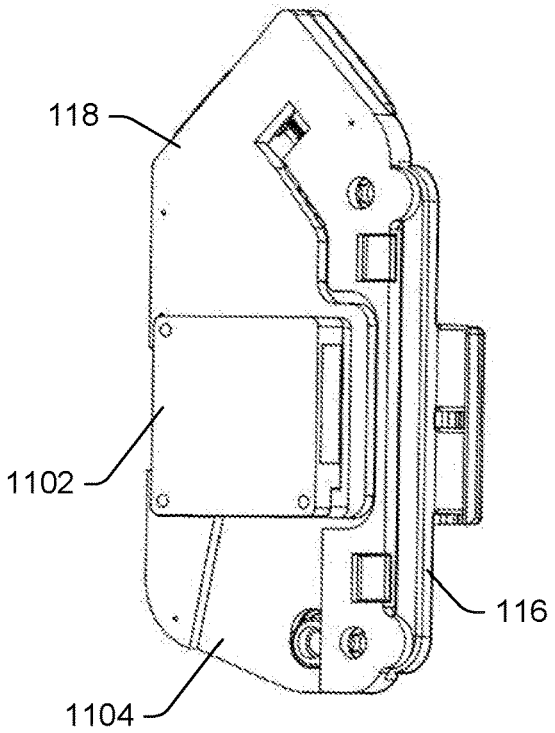
Figure 12:
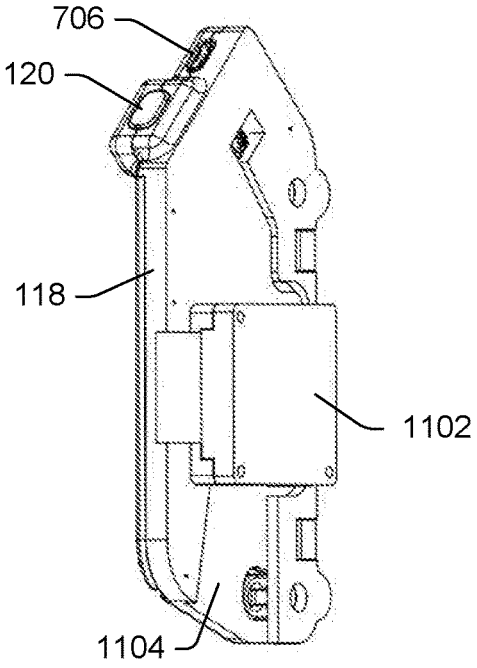
Figure 13:
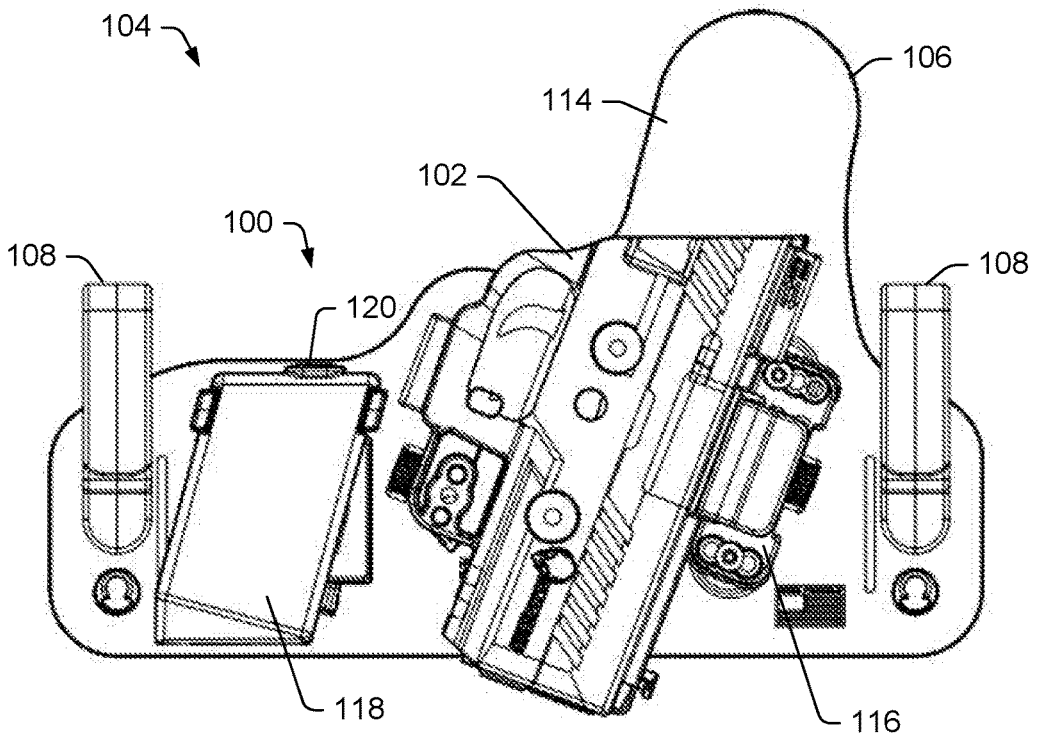
FIG. 13 shows a front view of an example holster with a cooling system, according to another implementation.
Figure 14:
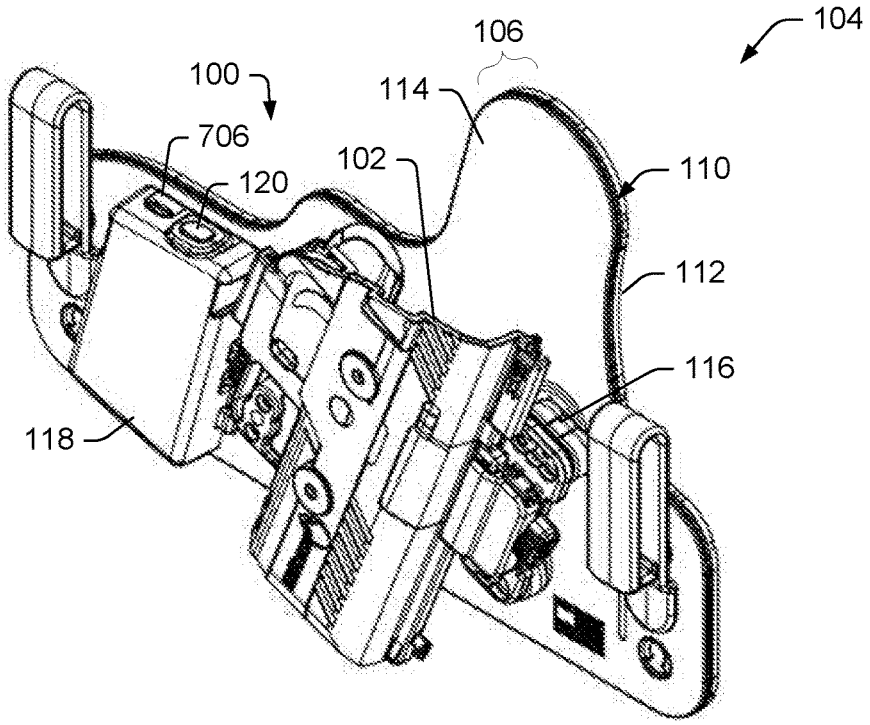
FIG. 14 shows a top perspective view of an example holster with a cooling system, according to the other implementation.
Figure 15:
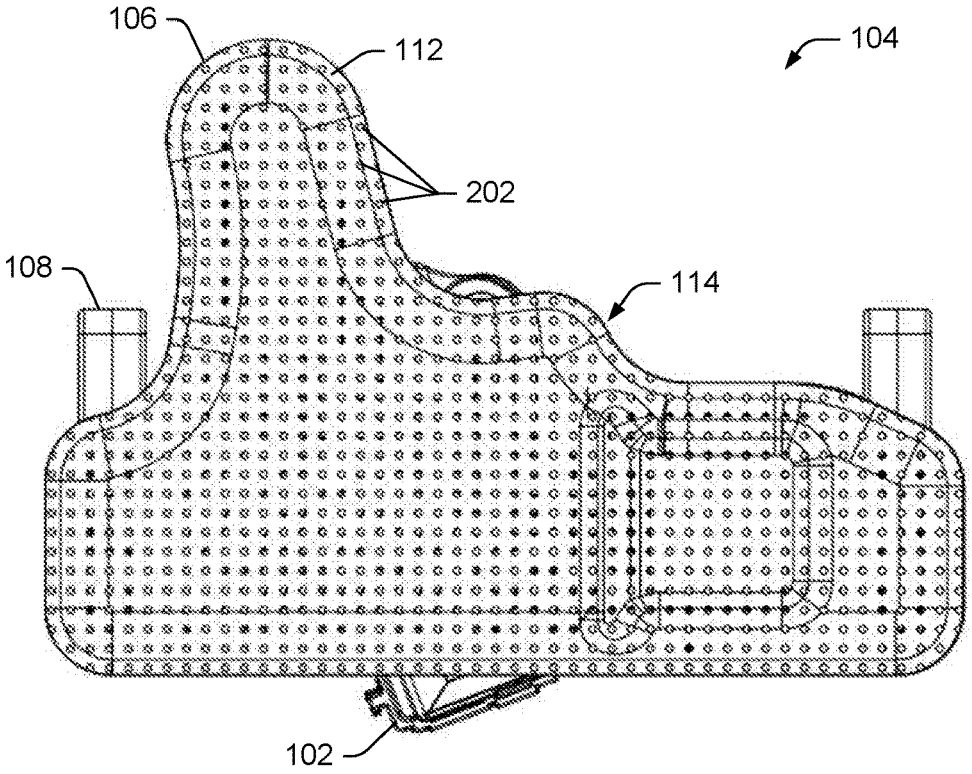
FIG. 15 shows a back view of an example holster with a cooling system, according to the other implementation.
Figure 16:
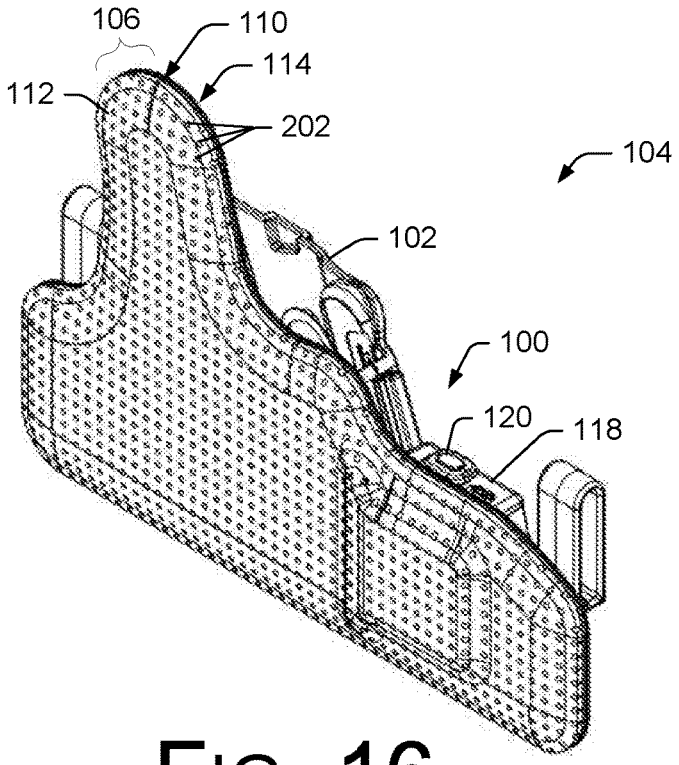
FIG. 16 shows a back perspective view of an example holster with a cooling system, according to the other implementation.

In an implementation, as shown in FIGS. 1, 3, and 7-9, the cooling assembly 118 can be coupled to the backer 106 over the opening 704 in the first layer 114. In the implementation, a portion 1102 of the cooling assembly 118 may protrude through one or both of the openings 704 and 804 in the first layer 114 and the ducting layer 110, respectively, of the backer 106. For instance, as shown in FIGS. 10-12, the fan, pump, blower, or the like, of the cooling assembly 118 may be housed in a portion 1102 of the cooling assembly 118, which may be shaped to fit within the openings 704 and 804, and may include one or more openings for fluid flow. The enclosure of the cooling assembly 118 may also include a duct or channel 1104 for drawing in air (or other fluid) or exhausting air, depending on the direction of fluid flow. The fan, pump, blower, or the like, of the cooling assembly 118 can be located near to the channel 1104 for efficiently moving the fluid through the channel 1104 and into or out of the backer 106.

For instance, as shown in FIGS. 7-9, the backer 106 includes the first layer 114 on an outer surface of the backer 106 next to the implement, a breathable layer 112 on another outer surface of the backer 106 next to the user, and a ducting layer 110 sandwiched between the first layer 114 and the breathable layer 112.

In an implementation, the cooling assembly 118 can pull air from the environment and force the air into the ducting layer 110 through the opening 704 in the first layer 114. The air circulates through the ducting layer 110 as directed or channeled by the features 902, and exits through the openings 202 in the breathable layer 112 (or through the fabric of the breathable layer 112). In an alternate implementation, the cooling assembly 118 can pull air through the openings 202 in the breathable layer 112, through the features 902 of the ducting layer 110, and out the first layer 114, through the opening 704. In either case, the air flow at the breathable layer 112 next to the user's body, cools the user's body at the location of the backer 106.

In various embodiments, the cooling assembly 118 may be powered by a small direct current (DC) power supply, or the like, which may be internal to the cooling assembly 118, mounted on the backer 106 or carrier 102, or externally mounted or carried. Other power supply options may be used depending on the battery capability needed for a particular outing, for example. In some cases, solar cells may be mounted to the backer 106, the carrier 102, or another surface to assist in powering and/or charging the cooling assembly 118.

Additionally, various battery charging systems can also be incorporated within the cooling assembly 118, within one or more of the layers (110, 112, 114, for example), or the like. Some examples include a battery charging port 706, an induction coil for wireless charging, a solar collector, or the like.

In some implementations, the cooling assembly 118 may be manually switched on and off via a switch 120 on the housing of the cooling assembly 118. In another implementation, the cooling assembly 118 may be automatically switched on and off. In some cases, for instance, one or more temperature and/or humidity sensors (not shown) can be included with the cooling assembly 118 or mounted to one or more of the layers (110, 112, 114, for example) to trigger the operation of the cooling assembly 118 as desired. For instance, a control component (such as a switch, potentiometer, logic control, or the like) may be set manually or have a predetermined set point (temperature setting, humidity threshold, etc.) for automatically switching the cooling assembly 118 on and off based on information received from one or more temperature and/or humidity sensors. This may help to preserve battery life.

As shown in FIGS. 8 and 9, one or more additional layers may also be included with the multi-layer backer 106. Additional layers may include a rigidity layer 806 or member, a protective layer, or the like. The rigidity layer 806 may include a partial or full layer comprised of a metal, a metal alloy, fiberglass, plastic, a composite, an aramid, carbon fiber, or other stiff material, arranged to provide a desired stiffness to the backer 106. If present, the rigidity layer 806 may include one or more openings (such as opening 2806, shown at FIG. 28, for example) that align with one or more portions of the first layer 114, the ducting layer 110, or the inlet/outlets associated with the features 902 and/or the ducting layer 110.

FIGS. 13-17 show various views of a carrier 102 with a cooling system 100 (an actively cooled holster 104), according to another embodiment. In the illustrated example, the arrangement of the cooling system 100 is somewhat different, however the functionality is consistent with the discussion above. Accordingly, the components of a cooling system 100 or an actively cooled holster 104 may be arranged in various configurations and remain within the scope of the disclosure.

Figure 17:
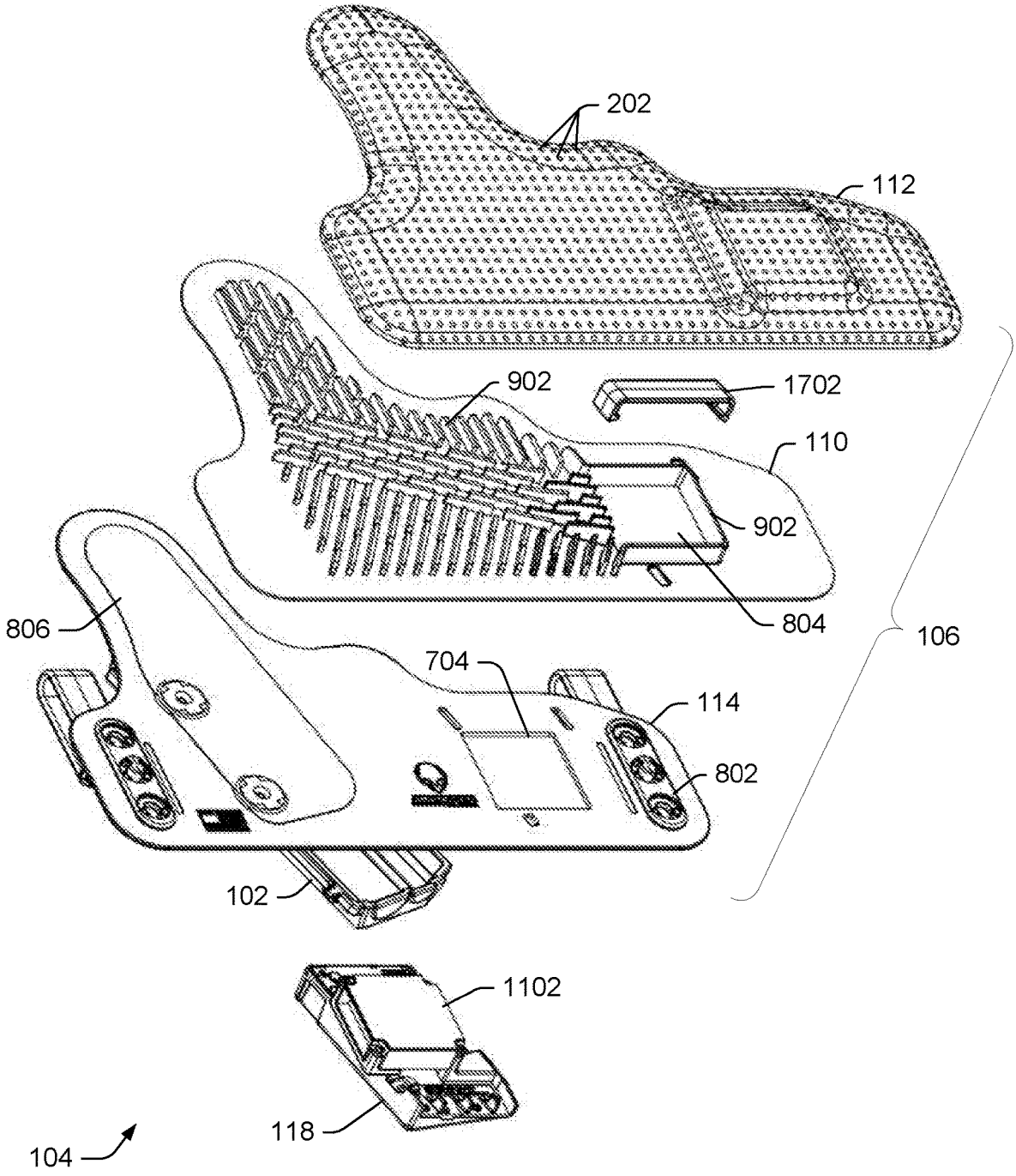
FIG. 17 shows an exploded view of an example holster with a cooling system, according to the other implementation.

As shown in FIG. 17, the arrangement of the features 902 of the ducting layer 110 may include any pattern or group of patterns for the desired fluid flow. In an embodiment, as shown in FIG. 17, the opening 804 in the ducting layer 110 may be partially (or fully) bordered by features 902 to assist in directing the fluid flow from (or to) the cooling assembly 118. One or more attachment clips 1702, or the like, may be used to assist in coupling the cooling assembly 118 to one or more of the layers (114, 110, 112, etc.) of the backer 106. For instance, the attachment clip(s) 1702 can be fixed to a layer, and the cooling assembly 118 can be pressed into the attachment clip(s) 1702 to hold the cooling assembly 118 in place during use. The cooling assembly 118 may be removed (unclipped) from the attachment clip(s) 1702 as desired for cleaning, to replace batteries, or the like, by pulling the cooling assembly 118 from the attachment clip(s) 1702.

FIGS. 18-22 show an example cooling assembly 118 according to another embodiment. As discussed above, the example cooling assembly 118 of FIGS. 18-22 includes a power button 120 and a charging port 706. Also, the cooling assembly 118 includes a protruding portion 1102 that houses the fan, blower, pump, etc., adapted to move fluid through the cooling system 100.

Figure 18:
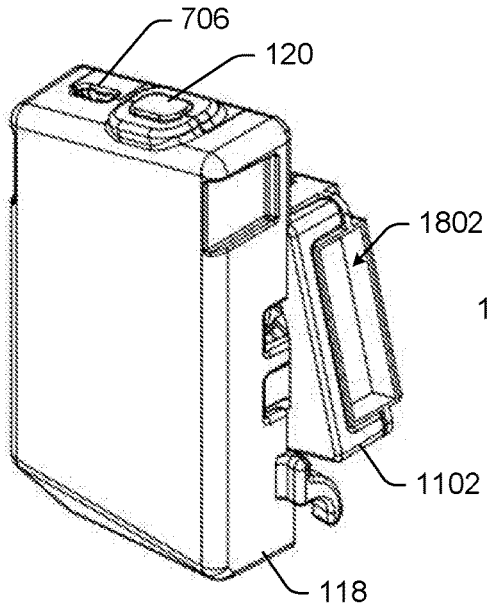
FIGS. 18-21 show a front perspective view, a back view, and two back perspective views, respectively, of an example cooling assembly for a holster, according to another implementation.
Figure 19:
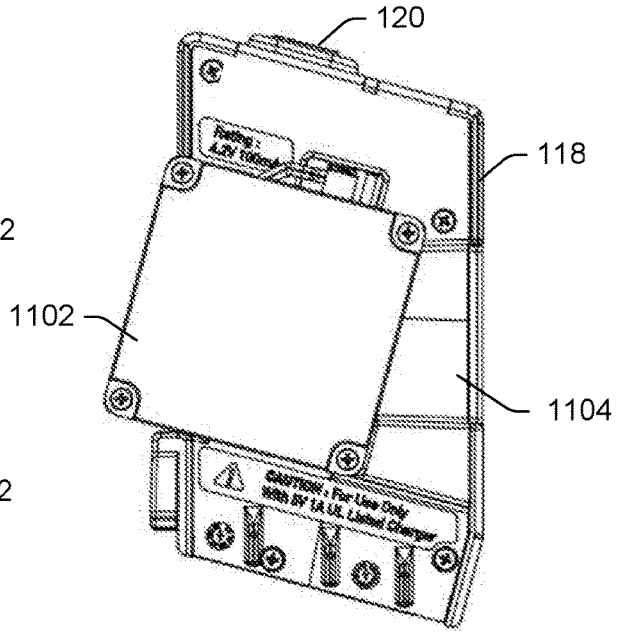
Figure 20:
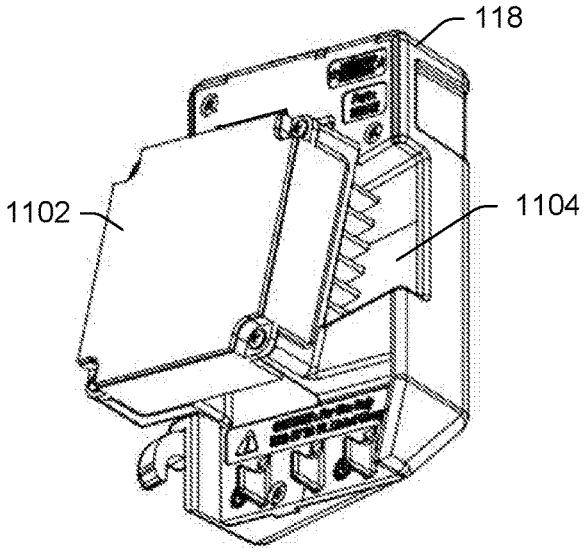
Figure 21:
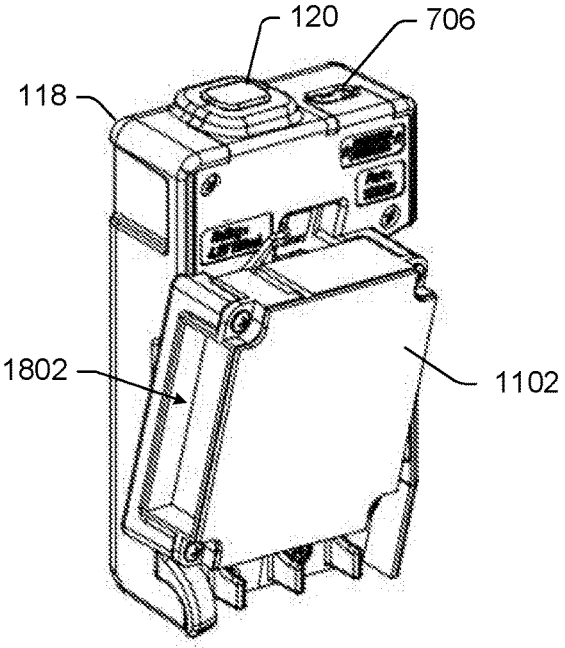

As shown in FIGS. 18 and 21, in the embodiment, the portion 1102 includes an opening 1802, which can be used as an output for the fan, blower, pump, etc., or an input, depending on the direction of fluid flow. In the embodiment, the opening 1802 is inserted into the opening 804 of the ducting layer 110, through the opening 704 in the first layer 110. This allows the opening 1802 to interface with the features 902 of the ducting layer 110, and to push fluid through the features 902 (or pull fluid).

Figure 22:
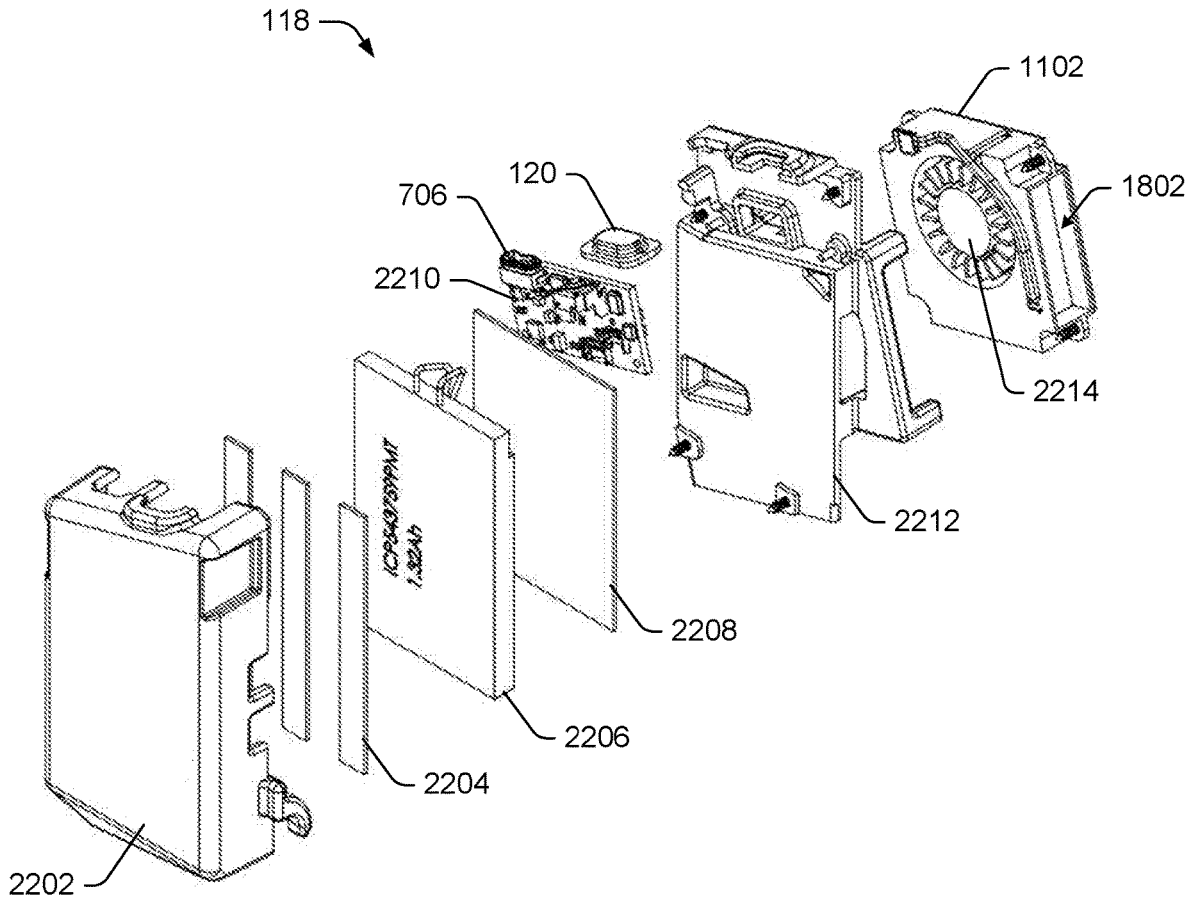
FIG. 22 shows an exploded view of an example cooling assembly for a holster, according to the other implementation.

FIG. 22 shows an exploded view of the example cooling assembly 118, and illustrates example components, according to the implementation. For instance, the example cooling assembly 118 includes a cover 2202, dampening material 2204, one or more batteries 2206, a divider 2208, a control board 2210, a base 2212, and one or more blowers 2214 within the portion 1102. In the example, the control board 2210 determines the operation of the blower(s) 2214 (power, speed, and direction of operation, for example) based on the position of the switch 120, and may also determine the operation of the blower(s) 2214 based on signals from one or more temperature and/or humidity sensors, as discussed above. In some implementations, the one or more temperature and/or humidity sensors are located within the cooling assembly 118, and in other implementations, they are located at other places on the backer 106, or the like, and are in communication with the control board 2210.

In alternate implementations, a cooling assembly 118 may include fewer components, additional components, or alternate components, and provide an equivalent function. For example, rather than blower(s) 2214, the mover for the cooling assembly 118 may comprise one or more fans, pumps, a compressed gas unit, or the like. Further, the components of the cooling assembly 118 may have different shapes, sizes, or arrangements, and remain within the scope of the disclosure.

Figure 23:
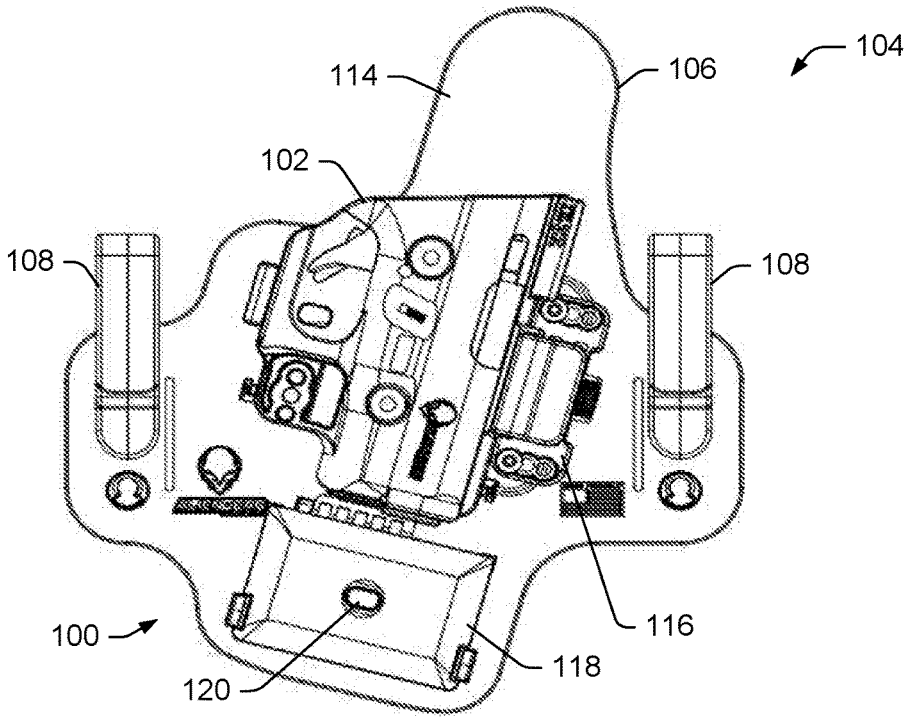
FIG. 23 shows a front view of an example holster with a cooling system, according to a further implementation.
Figure 24:
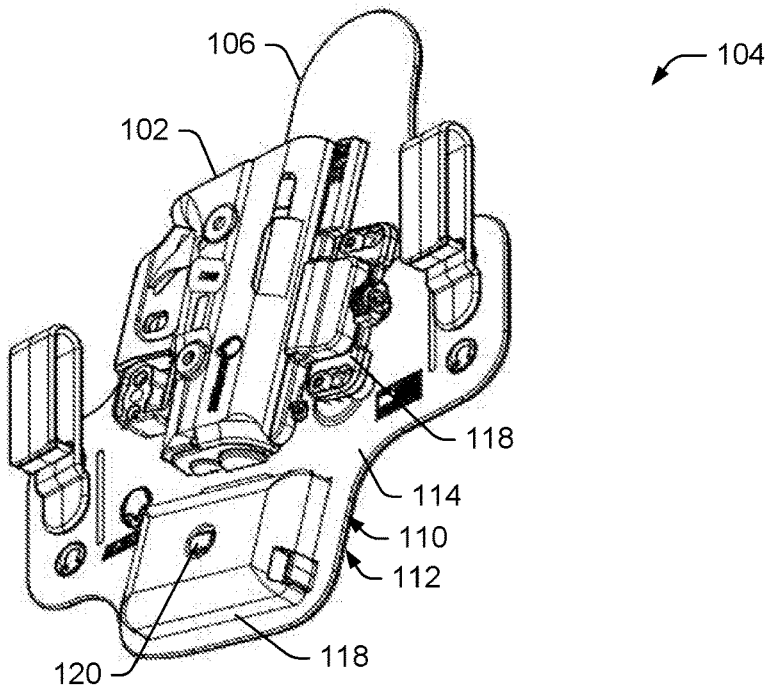
FIG. 24 shows a bottom perspective view of an example holster with a cooling system, according to the further implementation.
Figure 25:
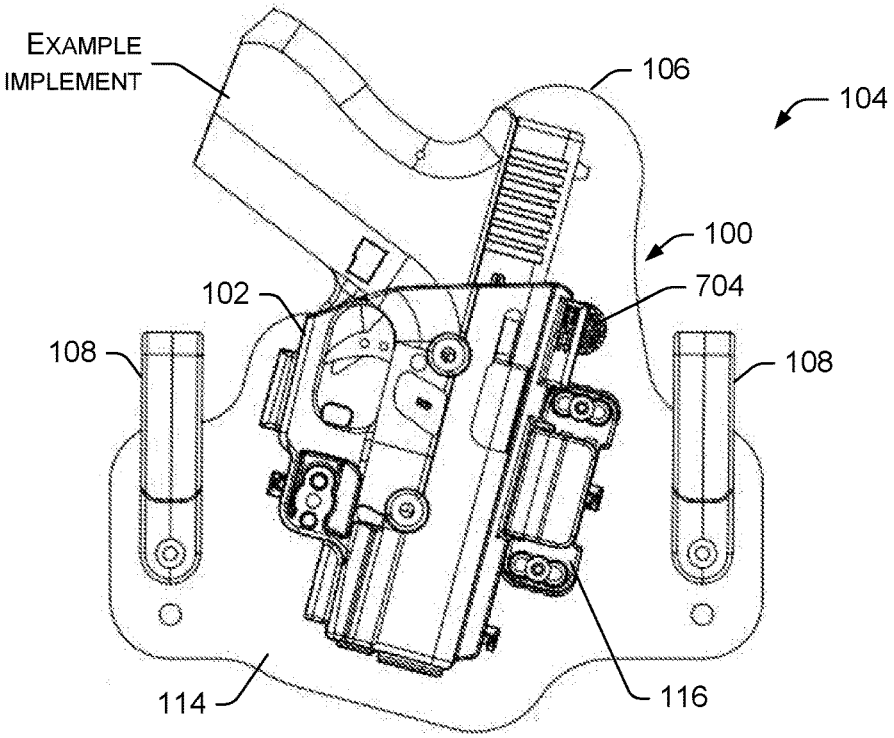
FIG. 25 shows a front view of an example holster with a cooling system, according to an additional implementation.
Figure 26:
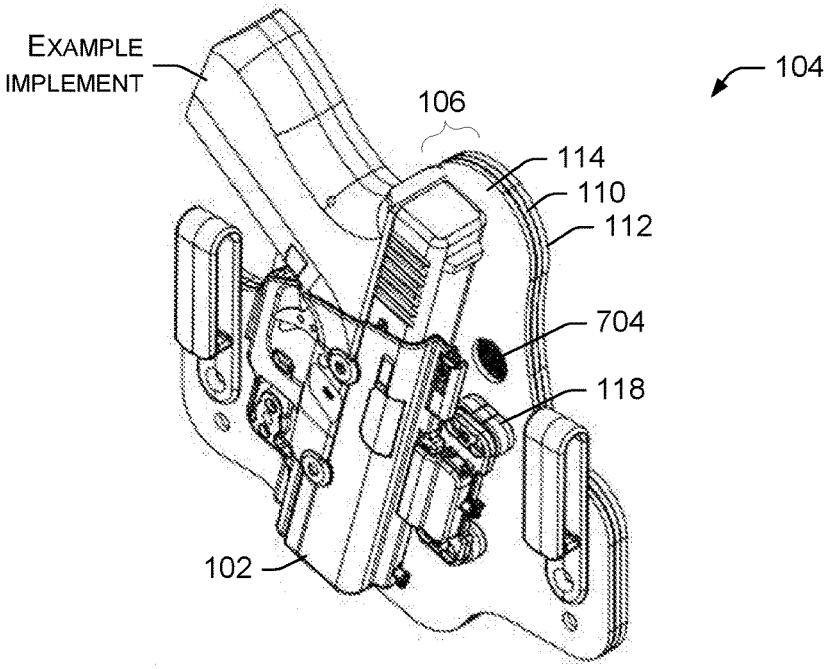
FIG. 26 shows a top perspective view of an example holster with a cooling system, according to the additional implementation.
Figure 27:
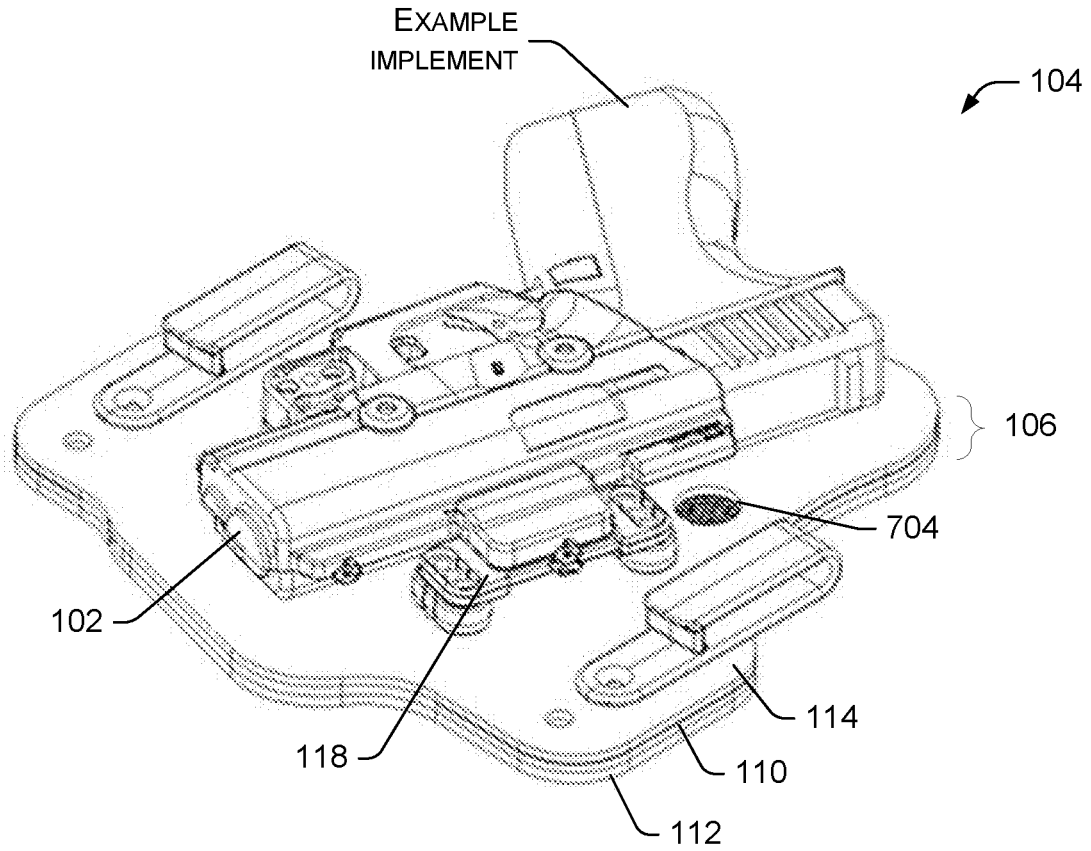
FIG. 27 shows a front perspective view of an example holster with a cooling system, according to the additional implementation.

FIGS. 23 and 24 show various views of a carrier 102 with a cooling system 100 (an actively cooled holster 104), according to another embodiment. In the illustrated example, the arrangement of the cooling system 100 is somewhat different, however the functionality is consistent with the discussion above. Accordingly, the components of a cooling system 100 or an actively cooled holster 104 may be arranged in various configurations and remain within the scope of the disclosure.

FIGS. 25-29 show various views of a carrier 102 with a cooling system 100 (an actively cooled holster 104), according to a further embodiment. In the illustrated example, the cooling assembly 118 is mounted within the layers of the backer 106, rather than on the surface of the first layer 114 of the backer 106. In the example embodiment shown, the power supply (not shown) for the cooling assembly 118 may be located remotely from the holster 104, or it may be located (or mounted) at various locations on the holster 104 or on the user, by design or at the user's discretion.

Figure 28:
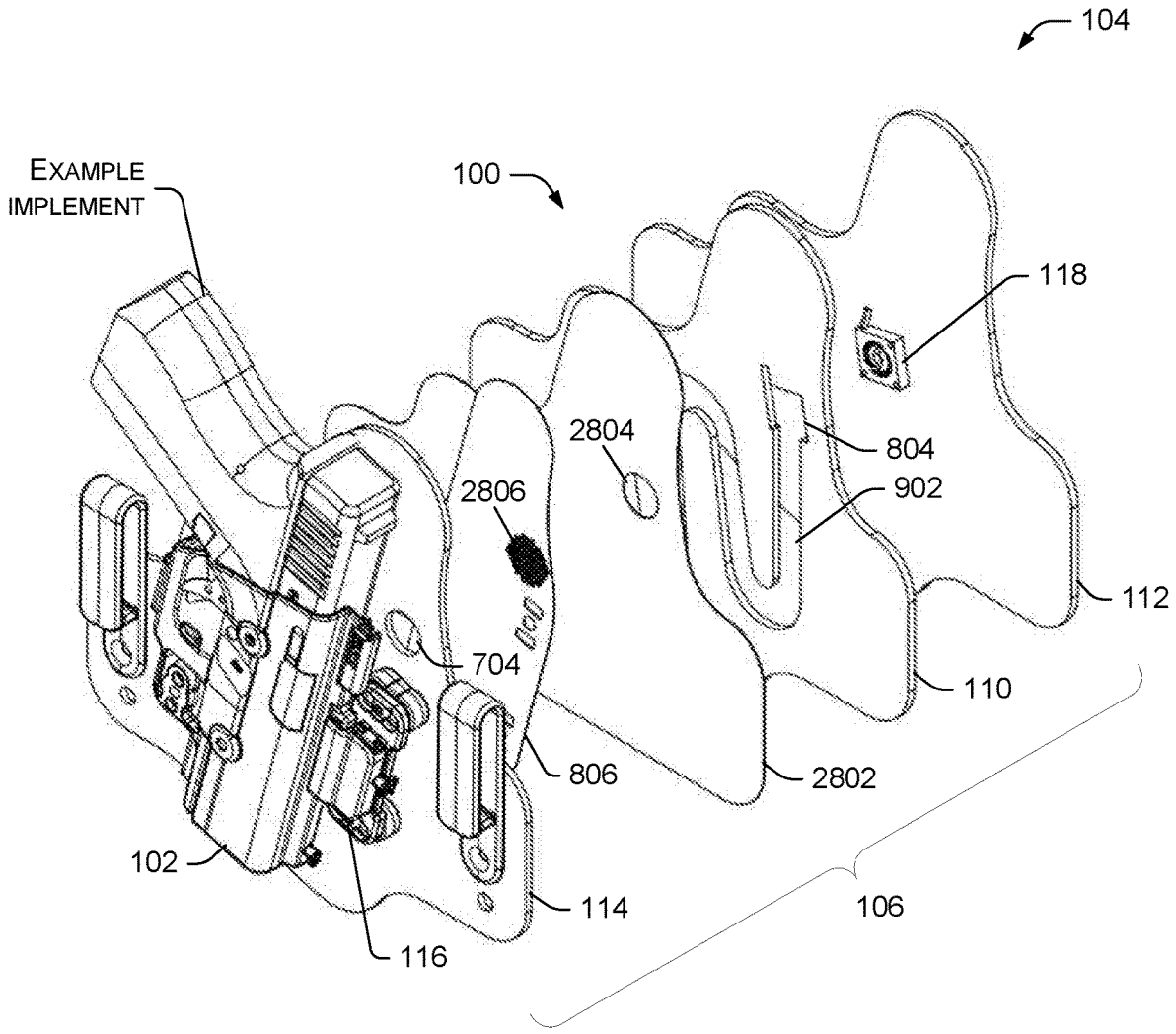
FIG. 28 shows an exploded view of an example holster with a cooling system, according to the additional implementation.
Figure 29:
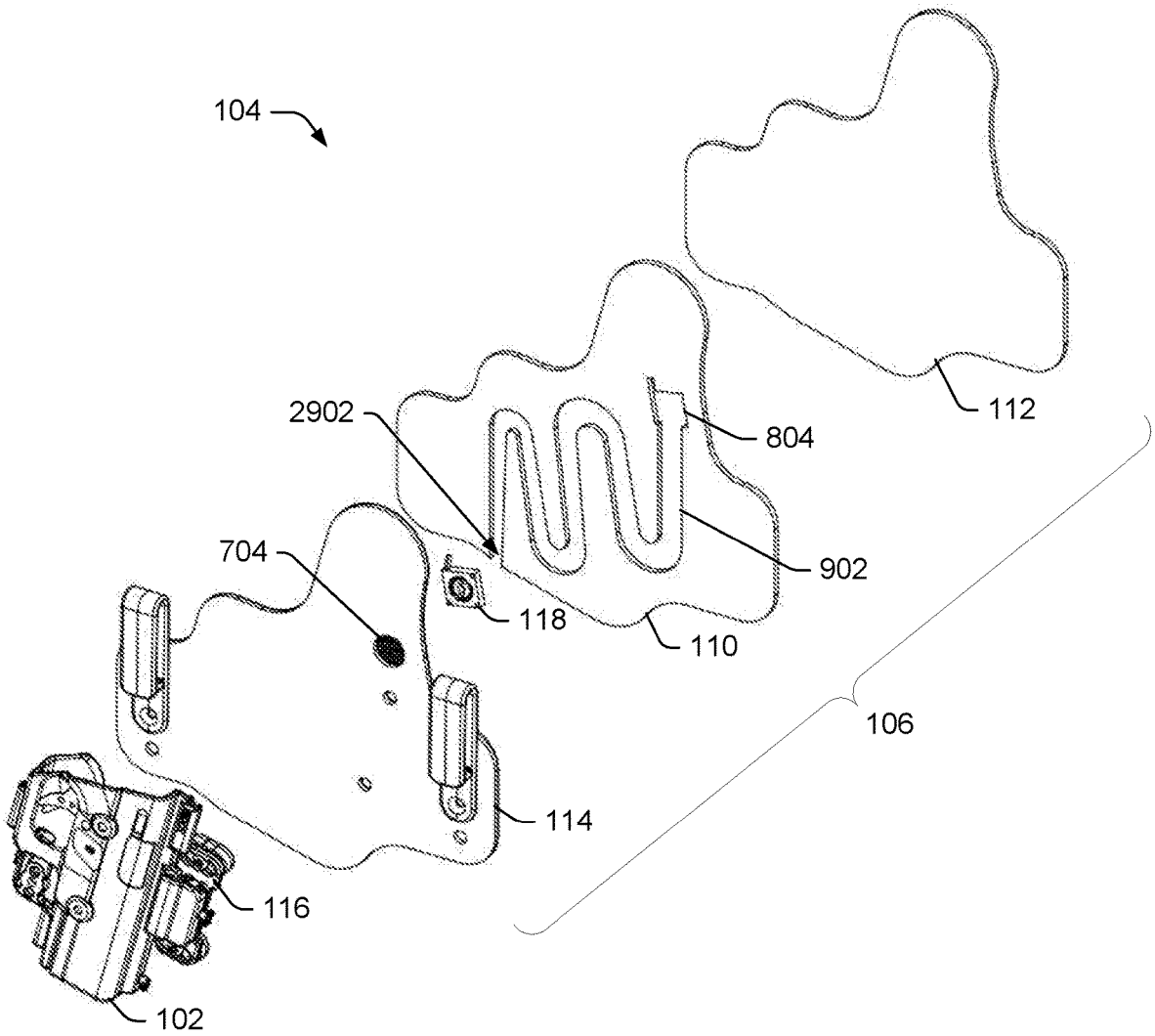
FIG. 29 shows another exploded view of an example holster with a cooling system, according to the additional implementation.

As shown in FIGS. 25-29, the opening 704 in the first layer 114 may be exposed to the environment at the front of the backer 106. In the embodiment, the cooling assembly 118 is located between the breathable layer 112 and the ducting layer 110 (and may be mounted to one or both layers). The cooling assembly 118 protrudes through the opening 804 of the ducting layer 110, and interfaces with the features 902. As shown in FIGS. 28 and 29, the features 902 may comprise a channel or series of channels.

FIG. 28 illustrates an embodiment having one or more additional backer 106 layers. For instance, the backer 106 may include a rigidity layer 806 and a protective layer 2802 disposed between the first layer 114 and the breathable layer 112 as shown, and one or more other layers in some cases. In the embodiment, the cooling assembly 118 pulls air (or other fluid) from the opening 704 in the first layer 114, through the opening 2806 in the rigidity layer 806 (if present), through the opening 2804 in the protective layer 2802 (if present), and through the features 902, and out an outlet 2902, which may be at the end of the features 902 in the ducting layer 110 (as shown in FIG. 29) or may be at another location. Of course, the fluid flow is opposite when the cooling assembly 118 is running the opposite direction.

The expanded view of FIG. 29 illustrates an embodiment with fewer layers, and so highlights the aspects of the example features 902 in greater detail. In various alternate embodiments, fewer layers, additional layers or alternate layers may be included with the backer, while providing the cooling functions desired.

The protective layer 2802 may be present to protect the ducting layer 110 from the rigidity layer 806. This can help prevent the rigidity layer 806 from damaging the ducting layer 110, which may be comprised of a much softer material. The protective layer 2802 may be comprised of a durable plastic or other material arranged to be thin but provide the desired protection.

One or more of the openings 704, 2806, 2804, etc. may include a protective screen, or the like, to prevent objects from passing through the features 902 of the ducting layer 110 and from passing through the fan, blower, pump, etc. of the cooling assembly 118. This can prevent objects from blocking the fluid flow through the ducting layer 110 and/or damaging the cooling assembly 118. Protective screens may also be used at any or all of the inlets and outlets of the holster 104.

In some alternate examples, other cooling techniques may be provided using additional or alternate layers, and further layers may be used for comfort, performance, or protection as desired. For instance, the cooling function may also be provided using forced evaporation (e.g., various forced air fans or ducting techniques), thermocouple heat transfer, circulating fluids other than air for cooling, inserting dry ice within the cooling assembly 118, employing an endothermic chemical reaction, releasing pressurized or compressed gas (e.g., air, CO2, liquid nitrogen, etc.) from the cooling assembly 118, including a miniaturized refrigeration system within the cooling assembly 118 and a closed system of features 902 in the ducting layer 110, and the like.

Figure 30:
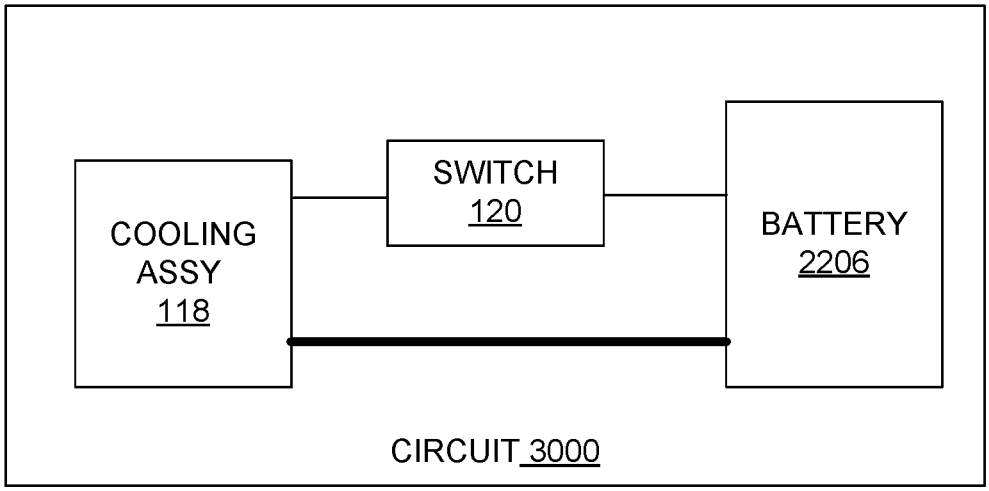
FIGS. 30 and 31 illustrate two example circuits for a holster with a cooling system, according to an implementation.
Figure 31:
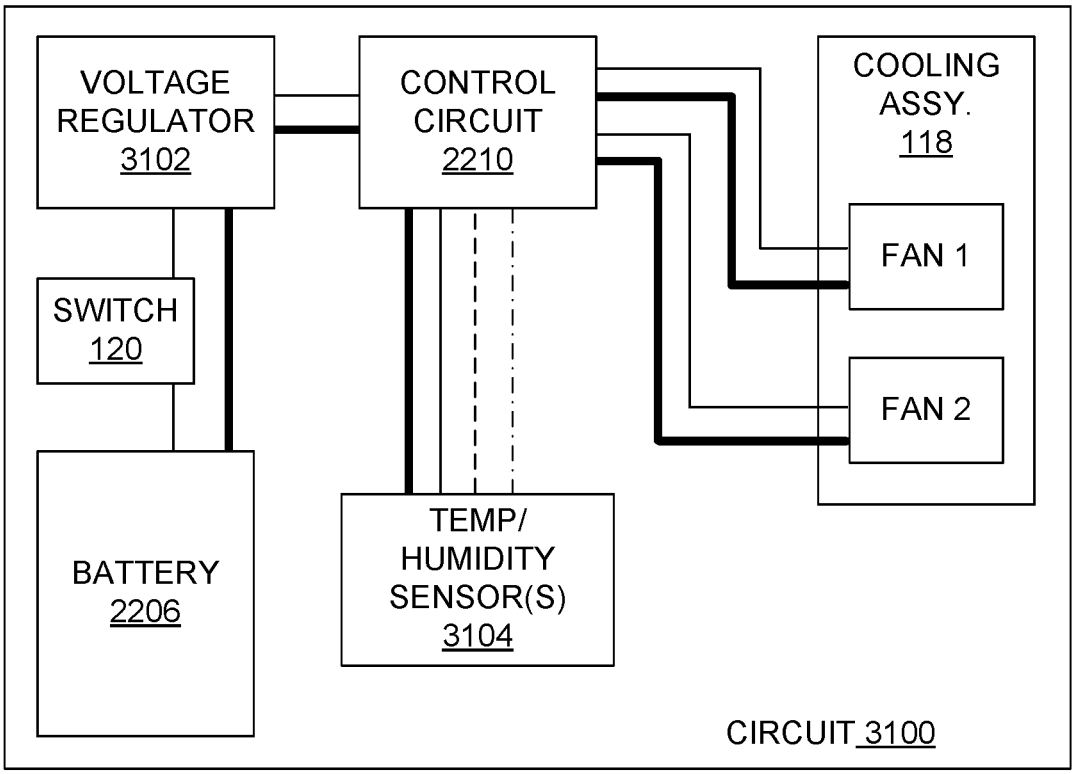

Two example circuits are shown in FIGS. 30 and 31 for control of the cooling system 100. At FIG. 30, the simple circuit 3000 illustrated includes a manually and/or automatically activated switch 120 to power the cooling assembly 118 fan (or other powered cooling component). The battery 2206 may be internal to the cooling assembly 118, the backer 106, or holster 104, or it may be externally mounted or carried.

At FIG. 31, the more complex circuit 3100 includes a voltage regulator 3102 to condition (change the voltage level, smooth the voltage characteristic, suppress transients or over-voltages, etc.) the power received from the battery 2206 (or other power source). The more complex circuit 3100 also includes a temperature/humidity sensor 3104 to send trigger signals to the control circuit 2210 based on preselected temperature and/or humidity settings. The control circuit 2210 then activates and deactivates one or more cooling components of the cooling assembly 118 (such as fan 1 and fan 2, for instance) for desired cooling, at least partially based on the signals received from the sensor 3104. In another example, the control circuit 2210 may signal to increase the speed of one or more of the cooling components at predetermined incrementally higher temperature or humidity set points, and lower the speed of the cooling components at predetermined incrementally lower temperature or humidity set points. In alternate embodiments, other or additional circuit components may be used for the described functionality, and remain within the scope of the disclosure.

In various implementations, cooling system 100 devices may include additional or alternate components, or have different shapes or sizes than those illustrated. The cooling system 100 components disclosed herein have been illustrated to be used with handgun holsters and holster shells. However, the cooling system 100 components disclosed herein may also be used with the holders or cases of any tools or implements.

Although various implementations and examples are discussed herein, further implementations and examples may be possible by combining the features and elements of individual implementations and examples.

In various embodiments, the cooling system 100, may be added to an existing arrangement (such as existing holsters and holster mounting apparatus and assemblies, for example). For instance, the existing arrangements may be retrofitted with the cooling system 100 or with cooling system 100 components. In other embodiments, the cooling system 100 may be a part of a new arrangement, such as a new holster 104, case, enclosure, or the like.

Representative Process

Figure 32:
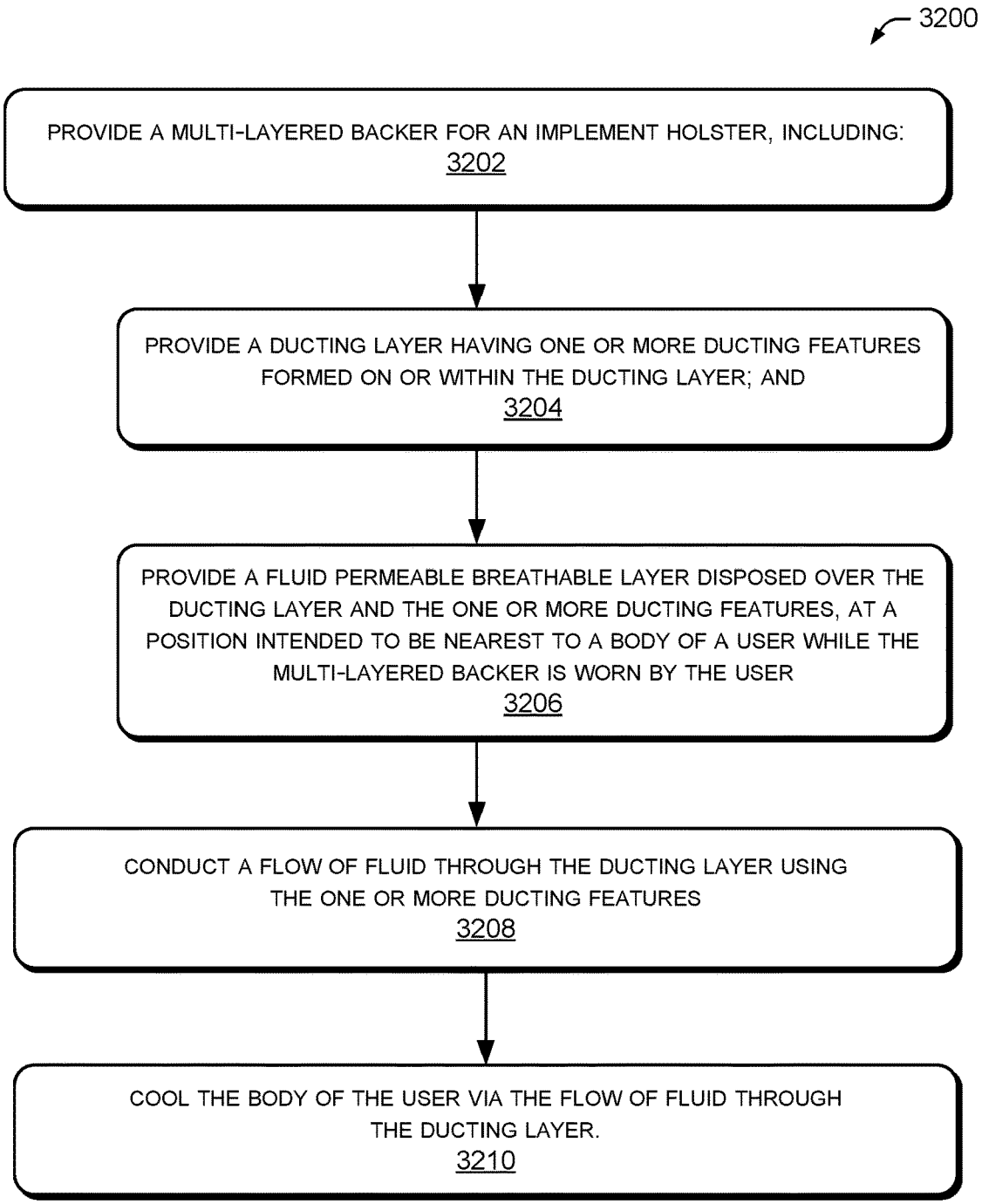
FIG. 32 is a flow diagram illustrating an example process of cooling a holster with a cooling system, according to an implementation

FIG. 32 illustrates a representative process 3200 for implementing techniques and/or devices relative to providing cooling on a holster (such as the holster 104, for example), according to various embodiments. The cooling may be provided by a cooling system (such as cooling system 100, for example). The process 3200 includes incorporating the cooling system with a holster or retrofitting a holster (or other carrier) with the cooling system to form an actively cooled holster. The example process 3200 is described with reference to FIGS. 1-31.

The order in which the process is described is not intended to be construed as a limitation, and any number of the described process blocks can be combined in any order to implement the process, or alternate processes. Additionally, individual blocks may be deleted from the process without departing from the spirit and scope of the subject matter described herein. Furthermore, the process can be implemented in any suitable hardware, software, firmware, or a combination thereof, without departing from the scope of the subject matter described herein.

At block 3202, the process includes providing a multi-layered backer (such as the backer 106, for example) for an implement holster. The multi-layered backer may include any number of layers, and include the two layers described at blocks 3204 and 3206.

At block 3204, the process includes providing a ducting layer (such as the ducting layer 110, for example) having one or more ducting features (such as the features 902, for example) formed on or within the ducting layer. At block 3206, the process includes providing a fluid permeable breathable layer (such as breathable layer 112, for example) disposed over the ducting layer and the one or more ducting features. The breathable layer is disposed at a position intended to be nearest to a body of a user while the multi-layered backer is worn by the user.

At block 3208, the process includes conducting a flow of fluid through the ducting layer using the one or more ducting features, as described above. At block 3210, the process includes cooling the body of the user via the flow of fluid through the ducting layer. For instance, a flow of air from the ducting layer and passing through the breathable layer can cool the body of the user at the location of the backer, including evaporating moisture on the body of the user. In this example, the ducting features may comprise an open system to the environment, where air is pulled from the environment, passes through the ducting layer, and back out to the environment through the breathable layer (which may include one or more formed holes, or the like).

In another example, cooling fluids circulating within the ducting layer may cool the air around the ducting features. The cooled air can pass through the breathable layer to cool the body of the user. A fan, or the like, and/or one or more other features, may assist in moving the cooled air out through the breathable layer (which may include the formed holes, or the like). In the example, the ducting features with the cooling fluids may comprise a closed system.

In an implementation, the process includes providing a cooling assembly (such as the cooling assembly 118, for example) adapted to move fluid through one or more of the layers of the multi-layered backer. In an embodiment, the process includes interfacing the cooling assembly to the ducting layer, and creating or increasing a flow of fluid through the ducting layer using the cooling assembly.

In one embodiment, the process includes pushing or pulling air from the environment and forcing the air through the ducting layer and out one or more openings in the breathable layer using the cooling assembly. In another embodiment, the cooling assembly moves the air in the opposite path. In other embodiments, the process includes moving other fluids (gasses, liquids, refrigerant, and so forth) through the ducting layer with the cooling assembly.

In an implementation, the process includes providing a first load bearing support layer (such as the first layer 114, for example) to the multi-layered backer in a position nearest to where an implement is to be carried within the implement holster. In one example, a holster may be coupled to the load bearing support layer.

In other implementations, other layers may also be added to the multi-layer backer. For instance, a rigidity layer may be added, which may comprise a full or partial layer, and may be comprised of a metal, an alloy, a composite, or another material adapted to give strength and rigidity to the backer. In another example, one or more protective layers may also be added to the backer.

In an implementation, the process includes removably coupling a holster or a holster shell to the multi-layer backer to form the implement holster. The holster is worn with the breathable layer closest to the body of the user.

In alternate implementations, other techniques may be included in the process in various combinations, and remain within the scope of the disclosure.

CONCLUSION

Although the implementations of the disclosure have been described in language specific to structural features and/or methodological acts, it is to be understood that the implementations are not necessarily limited to the specific features or acts described. Rather, the specific features and acts are disclosed as representative forms of implementing the claims.

What is claimed is:

1. A cooling system, comprising:

a multi-layered backer for an implement holster, comprising:

a ducting layer having ducting features including walls or ridges formed on the ducting layer and adapted to conduct a flow of fluid from an inlet opening of the ducting layer and through passages on the ducting layer formed by the ducting features of the ducting layer; and a fluid permeable breathable layer disposed over the ducting layer and overlaying the ducting features, the breathable layer and the ducting features forming the passages, and arranged to be nearest to a body of a user, the breathable layer having one or more openings adapted to pass fluid from the passages through the breathable layer to provide cooling to the body of the user.

2. The cooling system of claim 1, the multi-layered backer further comprising a first layer arranged to be positioned nearest to an implement to be carried within the implement holster, the first layer comprising a load bearing support layer.

3. The cooling system of claim 1, the multi-layered backer further comprising a metal rigidity layer disposed between two layers of the multi-layered backer and arranged to provide stiffness and rigidity to the multi-layered backer.

4. The cooling system of claim 3, the multi-layered backer further comprising a protective layer disposed between the rigidity layer and the ducting layer and arranged to protect the ducting layer from abrasion from the rigidity layer.

5. The cooling system of claim 1, further comprising a cooling assembly interfaced to the ducting layer and adapted to move fluid through the passages of the ducting layer.

6. The cooling system of claim 5, wherein the cooling assembly comprises one or more fans, pumps, or blowers.

7. The cooling system of claim 5, wherein the cooling assembly is disposed within one or more layers of the multi-layer backer or between two layers of the multi-layer backer.

8. The cooling system of claim 5, further comprising one or more temperature sensors and/or humidity sensors adapted to automatically trigger an operating condition of the cooling assembly.

9. The cooling system of claim 5, further comprising one or more openings in the ducting layer arranged to receive a portion of the cooling assembly and to interface the cooling assembly with the passages of the ducting layer.

10. The cooling system of claim 1, further comprising a holster shell coupled to the multi-layered backer to form the implement holster.

11. The cooling system of claim 1, wherein the ducting features comprise one or more of channels, ducts, conduit, tubing, directional features, or fins, to provide the passages for the movement of fluid.

12. The cooling system of claim 1, wherein the one or more openings of the breathable layer comprise formed holes, apertures, or perforations in the breathable layer.

13. An actively cooled holster for an implement, comprising:

a multi-layered backer, including:

a fluid impermeable ducting layer having ducting features including walls or ridges protruding from the ducting layer and adapted to conduct a flow of fluid through passages of the ducting layer formed by the ducting features; and a fluid permeable breathable layer disposed over the ducting layer and overlaying the ducting features, the breathable layer and the ducting features forming the passages, and arranged to be nearest to a body of a user, the breathable layer having one or more openings adapted to pass fluid from the passages through the breathable layer to provide cooling to the body of the user; and a holster shell removably or permanently coupled to the multi-layered backer and adapted to carry the implement.

14. The actively cooled holster of claim 13, further comprising a first layer arranged to be positioned nearest to the implement to be carried within the holster, the first layer comprising a load bearing support layer.

15. The actively cooled holster of claim 14, wherein the first layer includes an opening to the ducting layer, the opening of the first layer adapted to pass air between the environment and the ducting layer, through the first layer.

16. The actively cooled holster of claim 13, further comprising a metal rigidity layer disposed between two layers of the multi-layered backer and arranged to provide stiffness and rigidity to the multi-layered backer.

17. The actively cooled holster of claim 13, further comprising a cooling assembly interfaced with the ducting layer and adapted to pull or push fluid through the passages of the ducting layer to create or increase a flow of fluid through the ducting layer.

18. The actively cooled holster of claim 17, wherein the cooling assembly is adapted to pull or push fluid through the openings of the breathable layer.

19. The actively cooled holster of claim 17, wherein the cooling assembly includes one or more of a fan, a pump, or a blower.

20. A method, comprising:

providing a multi-layered backer for an implement holster, including:

providing a ducting layer having ducting features including walls or ridges formed on the ducting layer; and providing a fluid permeable breathable layer disposed over the ducting layer and overlaying the ducting features, at a position intended to be nearest to a body of a user while the multi-layered backer is worn by the user;

forming passages on the ducting layer from the ducting features and the breathable layer;

conducting a flow of fluid through the passages of the ducting layer; and cooling the body of the user via the flow of fluid through the passages of the ducting layer.

21. The method of claim 20, further comprising providing a first load bearing support layer to the multi-layered backer in a position nearest to where an implement is to be carried within the implement holster.

22. The method of claim 20, further comprising providing a cooling assembly adapted to move fluid, interfacing the cooling assembly to the ducting layer, and creating or increasing a flow of fluid through the ducting layer using the cooling assembly.

23. The method of claim 22, further comprising pulling air from the environment and forcing the air through the ducting layer and out one or more openings in the breathable layer using the cooling assembly.

24. The method of claim 20, further comprising removably coupling a holster or a holster shell to the multi-layer backer to form the implement holster.

* * * * *